US006820595B2

(12) United States Patent
Kobayashi et al.

(10) Patent No.: US 6,820,595 B2
(45) Date of Patent: Nov. 23, 2004

(54) FUEL INJECTION AMOUNT CONTROL METHOD AND APPARATUS OF INTERNAL COMBUSTION ENGINE

(75) Inventors: Daisuke Kobayashi, Toyota (JP); Kazunori Kojima, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/716,418

(22) Filed: Nov. 20, 2003

(65) Prior Publication Data

US 2004/0107946 A1 Jun. 10, 2004

(30) Foreign Application Priority Data

Nov. 27, 2002 (JP) ..... 2002-344564

(51) Int. Cl.[7] ..... F02M 51/00
(52) U.S. Cl. ..... 123/478; 123/480
(58) Field of Search ..... 123/478, 480; 701/103, 104, 105

(56) References Cited

U.S. PATENT DOCUMENTS 4,463,731 A * 8/1984 Matsuoka ..... 123/492
4,481,928 A * 11/1984 Takimoto et al. ..... 123/492
5,237,979 A * 8/1993 Hyodo et al. ..... 123/520
5,485,826 A 1/1996 Ohata et al.
5,752,492 A * 5/1998 Kato et al. ..... 123/674
6,014,955 A 1/2000 Hosotani et al.

FOREIGN PATENT DOCUMENTS

JP A 10-205378 8/1998
JP B2 2830461 9/1998

* cited by examiner

*Primary Examiner*—John T. Kwon
(74) *Attorney, Agent, or Firm*—Oliff & Berridge, PLC

(57) ABSTRACT

A fuel injection amount control apparatus estimates an intake air amount for a present or coming suction stroke of a cylinder based on an estimated throttle opening, and calculates a pre-correction estimated necessary fuel amount based on the intake air amount. The apparatus also calculates an actual intake air amount based on an actual throttle opening at the end of the previous suction stroke, and calculates an actual necessary fuel amount based on the actual intake air amount. The apparatus then calculates an actual intake fuel amount based on an actual fuel injection amount for the previous suction stroke and a forward fuel behavior model, calculates a normal estimated necessary fuel amount by correcting the pre-correction necessary fuel amount according to a difference between the actual necessary fuel amount and the actual intake fuel amount, and calculates a fuel injection amount for this suction stroke, based on a reverse fuel behavior model, so as to induct fuel of the normal estimated necessary fuel amount into the cylinder.

7 Claims, 17 Drawing Sheets

FUEL INJECTION AMOUNT CONTROL METHOD AND APPARATUS OF INTERNAL COMBUSTION ENGINE

INCORPORATION BY REFERENCE

The disclosure of Japanese Patent Application No. 2002-344564 filed on Nov. 27, 2002, including the specification, drawings and abstract, is incorporated herein by reference in its entirety.

BACKGROUND OF THE INVENTION

1. Field of the Invention

The invention relates to fuel injection amount control method and apparatus of an internal combustion engine, and, more particularly, to apparatus and method of controlling a fuel injection amount so that the air/fuel ratio can be kept substantially constant even during transient operations of the engine.

2. Description of Related Art

In an internal combustion engine of an electronically-controlled fuel injection type, fuel is supplied to each of cylinders of the engine through fuel injection immediately before the suction stroke of the cylinder or during the suction stroke. The cylinder that currently needs to be supplied with the fuel will be hereinafter called "fuel injection cylinder". This type of the engine is required to calculate an amount of intake air drawn into the fuel injection cylinder during the suction stroke, and inject fuel in an amount matching the calculated intake air amount by the time when a corresponding intake valve is closed at the end of the suction stroke (i.e., by a point in time when the intake valve shifts from an open state to a closed state) at the latest. In some cases, the fuel needs to be injected prior to a start of the suction stroke.

To meet the above requirements, a control apparatus of an internal combustion engine as disclosed in, for example, U.S. Pat. No. 6,014,955 estimates an opening angle of a throttle valve as one of operating state quantities of the engine up to the time of closing of the intake valve of the fuel injection cylinder, and estimates an amount of intake air that will be present in the fuel injection cylinder at the time of closing of the intake valve, based on at least the estimated throttle opening and an air model that models the behavior of air in the intake system of the engine, at a point in time prior to the time of closing of the intake valve. The control apparatus then generates a command to inject fuel into the cylinder in an amount that matches the estimated intake air amount.

The conventional control apparatus as described above may suffer from the following problem: if a difference (or estimation error) arises between the estimated intake air amount and the actual intake air amount, for example, due to a difference between the estimated throttle opening and the actual throttle opening, the control apparatus, which is not provided with a means for compensating for the estimation error, cannot produce an appropriate value of the fuel injection amount, and the air/fuel ratio may fluctuate or deviate from a target value.

In the case where the conventional control apparatus is provided with a general feedback controller for performing feedback control so as to compensate for the estimation error, a feedback control system is desirably constructed so that feedback control constants, such as a proportional gain and an integration gain, used by the controller need not be frequently changed in response to frequently varying operating conditions (e.g., the engine speed and the temperature) of the engine, thereby making the feedback controller simple in construction.

SUMMARY OF THE INVENTION

It is therefore an object of the invention to provide a fuel injection amount control method and a fuel injection amount control apparatus, which use a feedback controller having a simple construction or arrangement, for promptly compensating for an estimation error in the intake air amount, thereby to promptly make the air/fuel ratio stable particularly during a transient engine operation, e.g., upon a sudden change of the throttle opening.

To accomplish the above and/or other object(s), there is provided according to a first aspect of the invention a method of controlling a fuel injection amount of an internal combustion engine with respect to a suction stroke for which fuel is injected, comprising the steps of (a) estimating an operating state quantity of the engine to be established at the time of closing of an intake valve in the suction stroke in question, at a point in time prior to the time of closing of the intake valve, (b) estimating an intake air amount in the suction stroke based on the estimated operating state quantity, (c) calculating, as a pre-correction estimated necessary fuel amount, a provisional fuel amount that is needed along with the estimated intake air amount to achieve a target air/fuel ratio, (d) calculating an actual necessary fuel amount as an amount of fuel actually needed for achieving the target air/fuel ratio in a previous suction stroke that precedes the suction stroke in question, based on a known value of the operating state quantity, at a point in time after closing of the intake valve in the previous suction stroke, (e) calculating an actual intake fuel amount as an amount of fuel actually inducted into a cylinder of the engine during the previous suction stroke, based on at least an amount of fuel actually injected for the previous suction stroke, (f) determining an excess or shortage of the fuel in the previous suction stroke based on the calculated actual necessary fuel amount and the calculated actual intake fuel amount, and calculating a fuel feedback correction amount corresponding to the determined excess or shortage of the fuel, (g) calculating a normal estimated necessary fuel amount by correcting the pre-correction estimated necessary fuel amount with the calculated fuel feedback correction amount, (h) calculating a fuel injection amount based on at least the calculated normal estimated necessary fuel amount, and (i) injecting the fuel having the calculated fuel injection amount for the suction stroke in question, at a point in time before the time of closing of the intake valve in the suction stroke.

The above-mentioned "suction stroke in question" may refer to the present suction stroke in which the cylinder for which the fuel injection amount is controlled according to the above method is currently placed, or to the coming suction stroke of the cylinder, namely, the suction stroke into which the cylinder comes next. In the method according to the above aspect of the invention, the "suction stroke in question", "previous suction stroke" and the "second previous suction stroke" may be the current or coming, previous and second previous suction strokes with respect to a particular cylinder that is an arbitrarily selected one of the cylinders provided in the engine, or may be the current or coming, previous and second previous suction strokes with respect to a non-particular cylinder for which fuel injection is performed next, out of the cylinders of the engine that successively enter the suction stroke.

In the fuel injection amount control method as described above, the amount of intake air that will be present in the cylinder at the time of closing of the intake valve in the suction stroke in question is estimated based on the estimated operating state quantity (e.g., an opening angle of a throttle valve), at a point in time earlier than the time of closing of the intake valve. Then, the pre-correction estimated necessary fuel amount is calculated as a provisional amount of fuel needed for achieving the target air/fuel ratio (e.g., the stoichiometric air/fuel ratio) if the estimated intake air amount is actually provided. Namely, the pre-correction estimated necessary fuel amount is calculated based on the estimated intake air amount and the target air/fuel ratio. Accordingly, the pre-correction estimated necessary fuel amount is influenced by an estimation error in the estimated intake air amount.

In the meantime, since the operating state quantity established at the time of closing of the intake valve in the previous suction stroke is known after closing of the intake valve in the previous suction stroke, the actual intake air amount in the previous suction stroke can be determined from the known operating state quantity. It is therefore possible to accurately determine the actual necessary fuel amount as the amount of fuel actually needed for making the air/fuel ratio of an air-fuel mixture in the cylinder equal to the target air/fuel ratio in the previous suction stroke. On the other hand, since the amount of fuel actually injected for the previous suction stroke is known after closing of the intake valve in the previous suction stroke, the actual intake fuel amount as an amount of fuel actually drawn into the cylinder during the previous suction stroke can be accurately determined based on at least the known fuel injection amount for the previous suction stroke.

In the fuel injection amount control method according to the above aspect of the invention, an excess or shortage of fuel in the previous suction stroke is calculated based on a difference between the actual necessary fuel amount and the actual intake fuel amount that are determined in the above-described manners, and the fuel feedback correction amount is calculated so as to compensate for the excess or shortage of the fuel. Subsequently, the normal estimated necessary fuel amount is calculated by correcting the pre-correction estimated necessary fuel amount with the fuel feedback correction amount, and the fuel injection amount is calculated based on at least the normal estimated necessary fuel amount. Accordingly, the excess or shortage of the fuel that occurs in the previous suction stroke is compensated for or eliminated in the present or coming suction stroke, and therefore the air/fuel ratio can be promptly stabilized and kept stable with high accuracy.

Also, the fuel injection amount is calculated based on the normal estimated necessary fuel amount resulting from correction using the fuel feedback correction amount. Accordingly, even in the case where the calculated fuel injection amount differs from the normal estimated necessary fuel amount by an amount that depends upon an operating state of the engine, such as the case where the fuel injection amount is calculated based on the normal estimated necessary fuel amount in view of the (actual) fuel deposition amount that varies depending upon the operating state of the engine as described later, the fuel of the normal estimated necessary fuel amount that surely reflects the fuel feedback correction amount is accurately drawn into the fuel injection cylinder, irrespective of the operating state of the engine, if the fuel of the calculated fuel injection amount is injected. Accordingly, feedback control constants, such as a proportional gain, used by a feedback controller for calculating the fuel feedback correction amount need not be changed depending upon the frequently varying operating state of the engine, and therefore the feedback controller can be made simple in construction.

According to a second aspect of the invention, there is provided an apparatus for controlling a fuel injection amount of an internal combustion engine including a fuel injector that injects a fuel in response to a command, with respect to a suction stroke for which the fuel is injected, which apparatus includes an operating state quantity estimating unit, operating state quantity acquiring unit, estimated intake air amount calculating unit, pre-correction estimated necessary fuel amount calculating unit, actual intake air amount calculating unit, actual necessary fuel amount calculating unit, actual intake fuel amount calculating unit, fuel feedback correction amount calculating unit, normal estimated necessary fuel amount calculating unit, fuel injection amount calculating unit and a fuel injection commanding unit. In the following, the function of each unit will be described.

The operating state quantity estimating unit estimates an operating state quantity of the engine to be established at a point in time that is later than the present time. The operating state quantity acquiring unit acquires an actual operating state quantity of the engine established at a point in time that is earlier than the present time. A typical example of the operating state quantity is an opening angle of a throttle valve.

The estimated intake air amount calculating unit calculates an estimated intake air amount as an amount of intake air that will be present in the cylinder at the time of closing of the intake valve in the current or coming suction stroke, at a first predetermined point in time that is earlier than the time of closing of the intake valve in this suction stroke. The estimated intake air amount is calculated based on the operating state quantity to be established at a point in time later than the first predetermined point, which quantity is estimated by the operating state quantity estimating unit, and an air model that models the behavior of air in the intake system of the engine. Namely, with regard to the cylinder that is about to enter the suction stroke (or has ready entered the suction stroke), the estimated intake air amount calculating unit estimates the intake air amount of this cylinder for the time of closing of the intake valve, at the first predetermined point that is earlier than the time at which the intake valve of the cylinder shifts from the open state to the closed state in the coming or present suction stroke (i.e., the time of closing of the intake valve).

The pre-correction estimated necessary fuel amount calculating unit calculates a pre-correction estimated necessary fuel amount as a provisional amount of fuel needed in the current or coming suction stroke, based on the estimated intake air amount, at a second predetermined point in time that is later than the first predetermined point and is earlier than the time of closing of the intake valve in this suction stroke. For example, the pre-correction estimated necessary fuel amount calculating unit may calculate the pre-correction estimated necessary fuel amount by dividing the estimated intake air amount by a target air/fuel ratio that is separately determined according to the operating state of the engine, or a predetermined air/fuel ratio.

The actual intake air amount calculating unit calculates an actual intake air amount as an amount of intake air that was actually present in the cylinder at the time of closing of the intake valve in a previous suction stroke that precedes the current or coming suction stroke, at a third predetermined point in time that is later than the time of closing of the intake valve in the previous suction stroke and is earlier than the time of closing of the intake valve in the current or coming suction stroke. The actual intake air amount is calculated based on the actual operating state quantity acquired by the operating state quantity acquiring unit and the air model. Since the third predetermined point is later than closing of the intake valve in the previous suction stroke, the operating state quantity used for calculating the actual intake air amount for the time of closing of the intake valve in the previous suction stroke is already known at this point and can be thus acquired by the operating state quantity acquiring unit. Thus, the actual intake air amount can be accurately determined based on the known operating state quantity and the air model.

The actual necessary fuel amount calculating unit calculates an actual necessary fuel amount as an amount of fuel actually needed in the previous suction stroke, based on the calculated actual intake air amount, at a fourth predetermined point in time that is later than the third predetermined point and is earlier than the time of closing of the intake valve in the current or coming suction stroke. For example, the actual necessary fuel amount calculating unit calculates the actual necessary fuel amount by dividing the actual intake air amount by the target air/fuel ratio, in a similar manner to the pre-correction estimated necessary fuel amount calculating unit.

The actual intake fuel amount calculating unit calculates an actual intake fuel amount as an amount of fuel actually inducted into the cylinder during the previous suction stroke, at a fifth predetermined point in time that is earlier than the time of closing of the intake valve in the current or coming suction stroke, based on at least an amount of fuel actually injected for the previous suction stroke. In this case, the actual intake fuel amount is preferably determined in view of the actual fuel deposition amount, as described later.

The fuel feedback correction amount calculating unit calculates a fuel feedback correction amount based on the calculated actual necessary fuel amount and the calculated actual intake fuel amount, at a sixth predetermined point in time that is later than the fourth and fifth predetermined points and is earlier than the time of closing of the intake valve in the current or coming suction stroke.

For example, since a difference between the calculated actual necessary fuel amount and the calculated actual intake fuel amount represents an excess or shortage of fuel in the previous suction stroke, the fuel feedback correction amount for compensating for the excess or shortage of the fuel is calculated by using the difference between the actual necessary fuel amount and the actual intake fuel amount, and a controller, such as a proportional-integral controller, that receives this difference as an input value.

The normal estimated necessary fuel amount calculating unit calculates a normal estimated necessary fuel amount as a normal fuel amount needed for the current or coming suction stroke, by correcting the calculated pre-correction estimated necessary fuel amount with the fuel feedback correction amount, at a seventh predetermined point in time that is later than the second and sixth predetermined points and is earlier than the time of closing of the intake valve in the current or coming suction stroke.

The fuel injection amount calculating unit calculates a fuel injection amount as an amount of fuel to be injected from the fuel injector for the current or coming suction stroke, based on at least the calculated normal estimated necessary fuel amount, at an eighth predetermined point in time that is later than the seventh predetermined point and is earlier than the time of closing of the intake valve in this suction stroke. In this case, the fuel injection amount calculating unit is preferably arranged to calculate the fuel injection amount so that, if the fuel of the calculated fuel injection amount is injected, the fuel of the normal estimated necessary fuel amount is inducted or drawn into the cylinder (fuel injection cylinder) during the current or coming suction stroke. Furthermore, it is preferable to determine the fuel injection amount in view of the actual fuel deposition amount, as described later.

The fuel injection commanding unit generates a command to inject the fuel having the calculated fuel injection amount, to the fuel injector, at a ninth predetermined point in time that is later than the eighth predetermined point and is earlier than the time of closing of the intake valve in the current or coming suction stroke. With the command thus generated, the fuel of the fuel injection amount is injected from the fuel injector.

The fuel injection amount control apparatus according to the above aspect of the invention repeatedly executes the above-described process for each suction stroke (with respect to each cylinder) so that an excess or shortage of the fuel that occurs in the previous suction stroke is immediately reflected (namely, compensated for) by the fuel injection amount for the coming and subsequent suction strokes. Accordingly, the air/fuel ratio can be kept at a stable value. Also, if the fuel is injected in the calculated fuel injection amount, the fuel of the normal estimated necessary fuel amount that surely reflects the fuel feedback correction amount is precisely inducted or drawn into the fuel injection cylinder, without regard to the operating state of the engine. Therefore, feedback control constants used for calculating the fuel feedback correction amount need not be changed depending upon the frequently varying operating conditions of the engine. Consequently, the feedback controller for calculating the fuel feedback correction amount can be made simple in construction.

In one preferred embodiment of the invention, the fuel injection amount control apparatus further includes an actual fuel deposition amount calculating unit that calculates an actual fuel deposition amount, and the actual intake fuel amount calculating unit calculates the actual intake fuel amount by using a forward model of the fuel behavior model, in view of the actual fuel deposition amount, while the fuel injection amount calculating unit calculates the fuel injection amount by using a reverse model of the fuel behavior model, in view of the calculated actual fuel deposition amount.

With the above arrangement, the fuel injection amount is determined while taking account of the fuel deposition amount that changes depending upon the operating state of the engine. Accordingly, an appropriate fuel injection amount is calculated for the fuel injection cylinder, and the air/fuel ratio can be made further stable.

More specifically, the actual fuel deposition amount calculating unit calculates an actual fuel deposition amount as an amount of fuel deposited after a particular suction stroke and before a suction stroke that comes next to the particular suction stroke, based on a fuel injection amount that is actually injected for the particular suction stroke, an actual fuel deposition amount as an amount of fuel deposited after a suction stroke that precedes the particular suction stroke and before the particular suction stroke, and the above-described fuel behavior model.

Namely, the actual fuel deposition amount calculating unit calculates a new actual fuel deposition amount (i.e., an amount of fuel deposited after the particular suction stroke), based on the amount of fuel deposited in the intake system, out of the amount of fuel actually injected for the particular suction stroke, and an amount of fuel remaining in the intake system, out of the actual amount of fuel deposited in the intake system before the particular suction stroke.

The actual intake fuel amount calculating unit calculates the actual intake fuel amount as an amount of fuel actually inducted into the cylinder during the previous suction stroke, based on a forward model of the fuel behavior model. The actual intake fuel amount is calculated from an amount of fuel actually inducted into the cylinder during the previous suction stroke, out of an amount of fuel actually injected for the previous suction stroke, and an amount of fuel actually inducted into the cylinder during the previous suction stroke, out of the actual fuel deposition amount calculated by the actual fuel deposition amount calculating unit as an amount of fuel actually deposited after a second previous suction stroke that precedes the previous suction stroke and before the previous suction stroke.

Namely, the actual intake fuel amount calculating unit calculates the sum of a portion of the actual fuel injection amount for the previous suction stroke, which portion is inducted into the fuel injection cylinder, and a portion of the actual amount of fuel deposited before the previous suction stroke, which portion is inducted into the fuel injection cylinder, as the intake fuel amount as the amount of fuel actually inducted into the cylinder during the previous suction stroke.

The fuel injection amount calculating unit calculates the fuel injection amount based on a reverse model of the fuel behavior model so that a sum of an amount of fuel to be inducted into the cylinder during the current or coming stroke, out of the fuel injection amount to be injected for this suction stroke, and an amount of fuel to be inducted into the cylinder during this suction stroke, out of the fuel deposition amount calculated by the actual fuel deposition amount calculating unit as an amount of fuel actually deposited after the previous suction stroke and before the current or coming suction stroke becomes equal to the calculated normal estimated necessary fuel amount.

Namely, the fuel injection amount calculating unit calculates the amount of fuel that should be injected from the fuel injector so that the normal estimated necessary fuel amount is inducted or drawn into the fuel injection cylinder, while taking account of a portion of the fuel injection amount that is inducted into the cylinder without adhering to the intake system, and a portion of the actual amount of fuel deposited before the current or coming suction stroke, which portion is inducted into the cylinder. The thus calculated injection amount is set as the fuel injection amount for the current or coming suction stroke.

With the above arrangement, the actual intake fuel amount is accurately calculated in view of the actual fuel deposition amount calculated with high accuracy based on the actual fuel injection amount. Thus, an excess or shortage of the fuel inducted into the cylinder is precisely determined, and the thus determined excess or shortage is reflected by the feedback correction amount, thus permitting the air/fuel ratio to be stable. Also, since the fuel injection amount is calculated in view of the actual fuel deposition amount calculated with high accuracy, a fuel whose amount is extremely close to the actual necessary fuel amount (i.e., the pre-correction estimated necessary fuel amount or normal estimated necessary fuel amount) is supplied to the fuel injection cylinder through injection of the fuel of the calculated fuel injection amount in the case where no estimation error is present in the intake air amount (i.e., where the fuel feedback correction amount is equal to zero). This also contributes to stabilization of the air/fuel ratio for each suction stroke.

In the case where the actual intake fuel amount calculating unit is arranged to calculate the actual intake fuel amount by using the forward model of the fuel behavior model in view of the actual fuel deposition amount, and the fuel injection amount calculating unit is arranged to calculate the fuel injection amount by using the reverse model of the fuel behavior model in view of the actual fuel deposition amount, it is preferable that the actual intake fuel amount calculating unit determines a fuel deposition rate and a fuel remaining rate used by the forward model of the fuel behavior model, based on the actual intake air amount for the time of closing of the intake valve in the previous suction stroke, and that the fuel injection amount calculating unit determines a fuel deposition rate and a fuel remaining rate used by the reverse model of the fuel behavior model, based on the estimated intake air amount.

With the above arrangement, the fuel deposition rate and the fuel remaining rate used by the actual intake fuel amount calculating unit in the forward model of the fuel behavior model are determined based on the actual intake air amount at the time of closing of the intake valve in the previous suction stroke, which is determined based on the operating state quantity that is known after closing of the intake valve in the previous suction stroke and the air model. Thus, the deposition rate and the remaining rate accurately represent the actual behavior of the fuel in the intake system of the engine. Accordingly, the actual intake fuel amount is calculated with further improved accuracy.

Also, the fuel deposition rate and the fuel remaining rate used by the fuel injection amount calculating unit in the reverse model of the fuel behavior model are determined based on the estimated intake air amount to be established at the time of closing of the intake valve in the present or coming suction stroke, which amount is determined based on the operating state quantity estimated by the operating state quantity estimating unit and the air model. Thus, the deposition rate and the remaining rate accurately represent the behavior of the fuel in the intake system of the engine, which is estimated for the time of closing of the intake valve in the present or coming suction stroke. Accordingly, the fuel injection amount that would result in induction of the fuel of the normal estimated necessary fuel amount into the fuel injection cylinder is calculated with further improved accuracy.

In another preferred embodiment of the fuel injection amount control apparatus as described above, the fuel feedback correction amount calculating unit calculates the fuel feedback correction amount based on at least a time integral value of a difference between the calculated actual necessary fuel amount and the calculated actual intake fuel amount, and the estimated intake air amount calculating unit and the actual intake air amount calculating unit are constructed such that, when the internal combustion engine is in a steady operating state, the estimated intake air amount calculated by the estimated intake air amount calculating unit and the actual intake air amount calculated by the actual intake air amount calculating unit become substantially equal to each other.

With the above arrangement, when the engine is in a steady operating state, the estimated intake air amount and the actual intake air amount become equal to each other, and therefore the pre-correction estimated necessary fuel amount calculated based on the estimated intake air amount becomes equal to the actual necessary fuel amount calculated based on the actual intake air amount. Accordingly, each time the engine is kept in a steady operating state for a predetermined period of time or longer, it is guaranteed that the time integral value of the difference between the calculated actual necessary fuel amount and the calculated actual intake fuel amount becomes equal to zero.

The above-indicated time integral value of the difference corresponds to a time integral value of an excess or shortage of the fuel. Accordingly, each time the engine returns to a steady operating state after shifting from a steady operating state to a transient operating state in which an excess or shortage of fuel is likely to occur, it is guaranteed that the time integral value of the excess or shortage of the fuel becomes equal to zero. Consequently, the average air/fuel ratio in a period in which the engine once shifts from the steady operating state to the transient operating state and then returns to the steady operating state (namely, the total intake air amount in this period/the total fuel (injection) amount in this period) can be made equal to a certain target air/fuel ratio (e.g., the stoichiometric air/fuel ratio).

Generally, a three-way catalyst having the function of storing and releasing oxygen is often mounted in the exhaust system of the engine, for purifying exhaust gas having an air/fuel ratio that deviates from the stoichiometric air/fuel ratio by a certain degree. The three-way catalyst performs the oxygen storage/release function with high efficiency when the amount of oxygen stored in the catalyst is kept at around a predetermined amount (for example, about a half of the maximum oxygen storage amount of the catalyst). Meanwhile, the oxygen storage amount of the three-way catalyst decreases when the air/fuel ratio of the exhaust gas flowing into the catalyst is rich, and increases when the air/fuel ratio of the exhaust gas is lean. Accordingly, if the average air/fuel ratio within the above-described period is equal to the target air/fuel ratio (e.g., the stoichiometric air/fuel ratio), the oxygen storage amount of the three-way catalyst does not change over the above-described period. Consequently, the oxygen storage amount of the catalyst can be maintained in the vicinity of the predetermined amount.

As is understood from the above description, where the three-way catalyst having the function of storing and releasing oxygen is mounted in the exhaust system of the engine, the oxygen storage/release function of the three-way catalyst does not deteriorate even in the case where the engine once shifts from the steady operating state to the transient operating state and then returns to the steady operating state. Thus, an otherwise possible increase in the amount of emissions of the exhaust gas can be prevented or suppressed.

In the fuel injection amount control apparatus as described above, the ninth predetermined point is actually required to be a point in time that is earlier than the time of closing of the intake valve by a period of time that is the sum of the time needed for fuel injection and the time needed for the injected fuel to be drawn into the cylinder. In the case of an internal combustion engine of in-cylinder or direct injection type, or in the case where the flow rate at which the fuel is injected by the fuel injector is considerably large, however, the ninth predetermined point may be any point in time prior to the time of closing of the intake valve. The ninth predetermined point may also be a point in time after a start of fuel injection.

BRIEF DESCRIPTION OF THE DRAWINGS

The foregoing and/or further objects, features and advantages of the invention will become more apparent from the following description of an exemplary embodiment with reference to the accompanying drawings, in which like numerals are used to represent like elements and wherein.

DETAILED DESCRIPTION OF EXEMPLARY EMBODIMENTS

Figure 1:
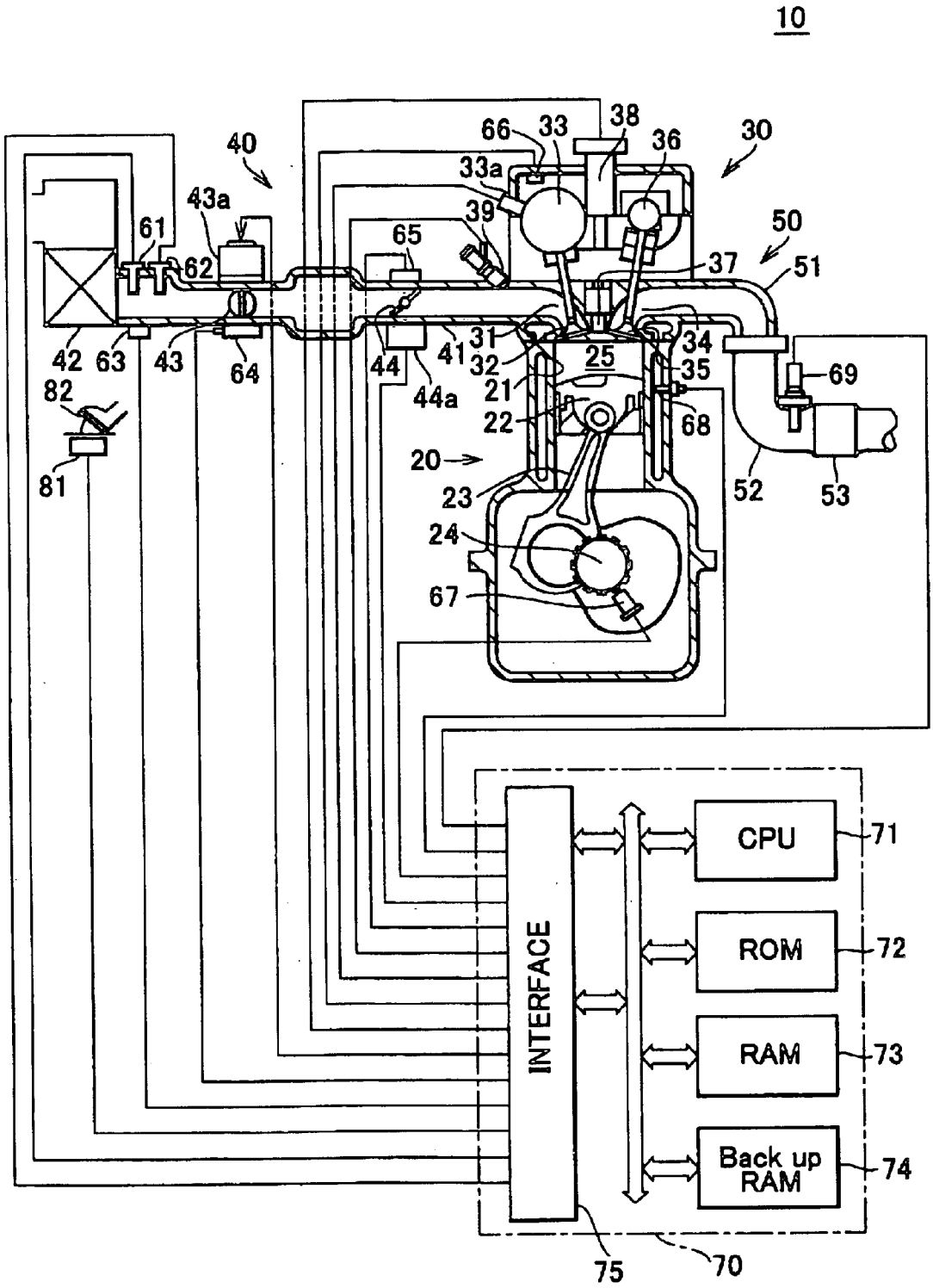
FIG. 1 is a view schematically showing a system in which a fuel injection amount control apparatus according to one exemplary embodiment of the invention is applied to a multi-cylinder internal combustion engine of spark ignition type.

A fuel injection amount control apparatus of an internal combustion engine according to an exemplary embodiment of the invention will be described in detail with reference to the accompanying drawings. FIG. 1 schematically shows a system in which the fuel injection amount control apparatus according to the embodiment of the invention is applied to a multi-cylinder (four-cylinder) internal combustion engine 10 of spark ignition type.

As shown in FIG. 1, the engine 10 has a cylinder block section 20 including a cylinder block, a cylinder block lower case, an oil pan and other components, a cylinder head section 30 fixed to the top of the cylinder block section 20, an intake system 40 for supplying a mixture of air and gasoline to the cylinder block section 20, and an exhaust system 50 for discharging exhaust gas from the cylinder block section 20 to the outside of the engine 10.

The cylinder block section 20 includes a cylinder 21, a piston 22, a connecting rod 23 and a crankshaft 24. The piston 22 is adapted to reciprocate within the cylinder 21, and the reciprocation of the piston 22 is transmitted to the crankshaft 24 via the connecting rod 23 so that the crankshaft 24 is rotated. Head portions of the cylinder 21 and the piston 22 cooperate with the cylinder head section 30 to form a combustion chamber 25.

The cylinder head section 30 includes an intake port 31 that communicates with the combustion chamber 25, an intake valve 32 for opening and closing the intake port 31, an intake camshaft for driving the intake valve 32, a variable intake timing device 33 for continuously varying the phase angle of the intake camshaft, and an actuator 33*a* for the variable intake timing device 33. The cylinder head section 30 also includes an exhaust port 34 that communicates with the combustion chamber 25, an exhaust valve 35 for opening and closing the exhaust port 34, and an exhaust camshaft 36 for driving the exhaust valve 35. The cylinder head section 30 further includes an ignition plug 37, an ignitor 38 including an ignition coil for generating a high voltage to be applied to the ignition plug 37, and an injector (or fuel injector) 39 for injecting fuel into the intake port 31.

The intake system 40 includes an intake pipe 41 that communicates with the intake port 31 and includes an intake manifold, and an air filter 42 provided in an end portion of the intake pipe 41. The intake pipe 41 including the intake manifold cooperates with the intake port 31 to form an intake passage. The intake system 40 further includes a throttle valve 43 disposed in the intake pipe 41 for varying the cross-sectional area of the intake passage, a throttle valve actuator 43*a* that provides a throttle valve driving unit, a swirl control valve 44 (which will be called "SCV" when appropriate), and a SCV actuator 44*a*. The throttle valve actuator 43*a* consists of a DC motor, and the SCV actuator 44*a* also consists of a DC motor.

When the throttle valve actuator 43*a* in the form of the DC motor receives a target throttle opening TAt according to an electronically controlled throttle valve logic realized by an electronic control unit 70 as described later, the actuator 43*a* drives the throttle valve 43 so that the actual throttle opening TA becomes equal to the target throttle opening TAt.

The SCV 44 is rotatably supported by the intake pipe 41 at a position downstream of the throttle valve 43 and upstream of the injector 39. When the SCV actuator 44*a* in the form of the DC motor receives a drive signal from the electronic control unit 70, the actuator 44*a* drives or rotates the SCV 44 so as to produce the swirling motion of the air drawn into the combustion chamber 25.

The above-mentioned exhaust system 50 includes an exhaust manifold 51 that communicates with the exhaust port 34, an exhaust pipe 52 connected to the exhaust manifold 51, and a catalytic converter (three-way catalyst device) 53 mounted in the exhaust pipe 52. The catalytic converter 53 has a function of storing and releasing oxygen.

In the meantime, the system of FIG. 1 includes a heat-wire-type air flow meter 61, an intake air temperature sensor 62, an atmospheric pressure sensor (i.e., a sensor for measuring a pressure upstream of the throttle valve) 63, a throttle position sensor 64 and a SCV opening sensor 65. The system further includes a cam position sensor 66, a crank position sensor 67, a water temperature sensor 68, an air/fuel ratio sensor 69 and an accelerator position sensor 81 that provides (a part of) an accelerator operation amount detector.

Figure 2:
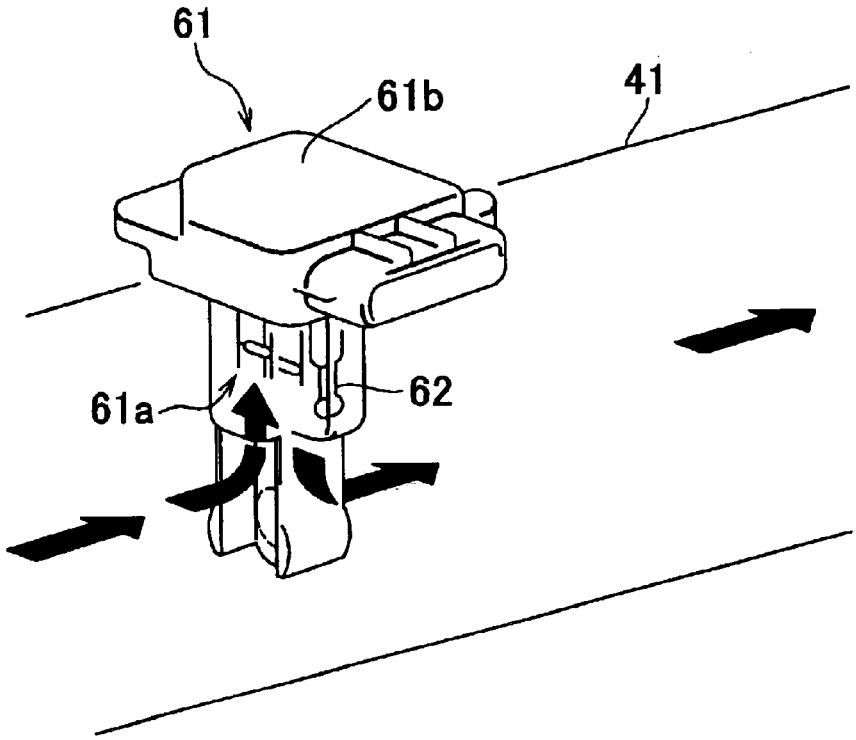
FIG. 2 is a schematic perspective view of an air flow meter of the engine shown in FIG. 1.
Figure 3:
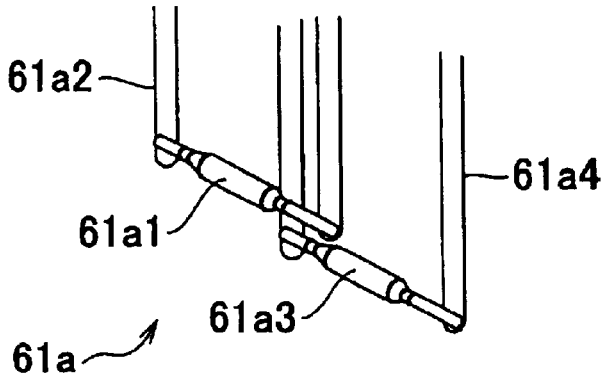
FIG. 3 is an enlarged perspective view of a heat wire measuring portion of the air flow meter shown in FIG. 2.
Figure 4:
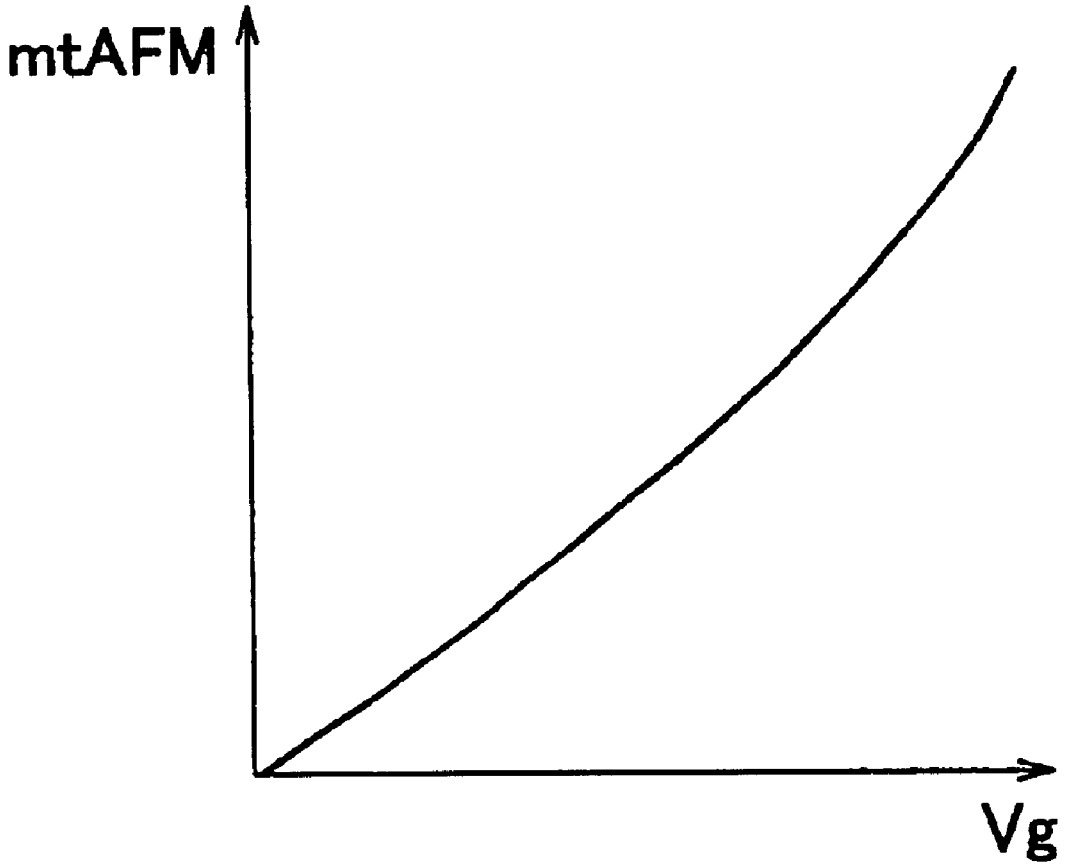
FIG. 4 is a graph representing a table that defines the relationship between the output of the air flow meter read by a CPU shown in FIG. 1, and an intake air amount (intake air flow rate)

As shown in the schematic perspective view of FIG. 2, the air flow meter 61 consists of a bypass passage that permits flow of a part of the intake air in the intake pipe 41, a heat wire measuring portion 61*a* and a signal processing portion 61*b*. The heat wire measuring portion 61*a* measures the mass flow of intake air that passes through the bypass passage, and the signal processing portion 61*b* outputs a voltage Vg corresponding to the mass flow thus measured. As shown in the enlarged perspective view of FIG. 3, the heat wire measuring portion 61*a* includes a resistor (a bobbin portion) 61*a*1 that consists of a platinum heat wire and serves to measure the intake air temperature, a support portion 61*a*2 that holds the resistor 61*a*1 and connects it with the signal processing portion 61*b*, a heating resistor (a heater) 61*a*3, and a support portion 61*a*4 that holds the heating resistor 61*a*3 and connects it with the signal processing portion 61*b*. The signal processing portion 61*b* includes a bridge circuit that consists of the resistor 61*al* for measuring the intake air temperature and the heating resistor 61*a*3. In operation, the signal processing portion 61*b* adjusts electric power supplied to the heating resistor 61*a*3 so that a difference in the temperature between the resistor 61*a*1 and the heating resistor 61*a*3 is kept always constant by the bridge circuit, and converts the thus supplied electric power to the voltage Vg, which provides an output signal of the air flow meter 61. The relationship between the output Vg of the air flow meter 61 and the measured intake air flow rate mtAFM is shown in, for example, FIG. 4. The electronic control unit 70 obtains the value of the measured intake air flow rate mtAFM, by using the relationship of FIG. 4.

The intake air temperature sensor 62, which is provided in the air flow meter 61, measures the temperature of the intake air, and outputs a signal indicative of the intake air temperature THA. The atmospheric pressure sensor 63 measures the pressure upstream of the throttle valve 43 (namely, the atmospheric pressure), and outputs a signal indicative of the throttle valve upstream pressure Pa. The throttle position sensor 64 measures the opening angle of the throttle valve 43, and outputs a signal indicative of the throttle opening TA. The SCV opening sensor 65 measures the opening angle of the SCV 44, and outputs a signal indicative of the SCV opening θiv.

The cam position sensor 66 generates a signal (G2 signal) having one pulse each time the intake camshaft rotates 90° (namely, each time the crankshaft 24 rotates 180°). The crank position sensor 67 outputs a signal having a narrow pulse each time the crankshaft 24 rotates 10° and having a wide pulse each time the crankshaft 24 rotates 360°. This signal represents the engine speed Ne. The water temperature sensor 68 measures the temperature of a coolant of the engine 10, and outputs a signal indicative of the coolant temperature THW. The air/fuel ratio sensor 69 detects the oxygen concentration in the exhaust gas flowing into the catalytic converter 53, and outputs a signal indicative of the air/fuel ratio A/F of the exhaust gas. The accelerator position sensor 81 detects an operation (or depression) amount of an accelerator pedal 82 operated by the driver, and outputs a signal indicative of the accelerator operation amount Accp.

The above-mentioned electronic control unit 70 is a microcomputer mainly consisting of CPU 71, ROM 72, RAM 73, backup RAM 74, interface 75 and other components, which are connected to each other by a bus. The ROM 72 stores, in advance, programs to be executed by the CPU 71, tables (e.g., lookup tables and maps), constants, and the like, and the RAM 73 allows the CPU 71 to temporarily store data therein as needed. The backup RAM 74 stores data while the power supply is in the ON state, and retains the stored data while the power supply is in the OFF state as well as the ON state. The interface 75, which includes AD converters, is connected to the sensors 61–69, 81 and various other sensors that are not illustrated. In operation, the interface 75 supplies signals from the sensors 61–69, 81 to the CPU 71, and sends drive/control signals to the actuator 33*a* of the variable intake timing device 33, ignitor 38, injector 39, throttle valve actuator 43*a* and the SCV actuator 44*a*, according to commands received from the CPU 71.

Next, a method in which the control apparatus constructed as described above determines the fuel injection amount by using physical models will be explained. The CPU 71 executes suitable programs so as to carry out processes as described below.

Method of Determining Fuel Injection Amount fi

The fuel injection amount control apparatus as described above needs to generate a command to inject a suitable amount of fuel into a cylinder that is in the suction stroke or a cylinder that is in an operating state immediately before the suction stroke, at a point in time prior to closing of the intake valve 32 of the cylinder. Such a cylinder that is in the suction stroke or immediately before the suction stroke will be called "fuel injection cylinder". In other words, a fuel needs to be injected into the fuel injection cylinder before the intake valve 32 shifts from an open state to a closed state during the suction stroke. To this end, the fuel injection amount control apparatus estimates in advance the amount of intake air that will be present in the cylinder at the time point when the intake valve 32 shifts to the closed state, and injects fuel into the cylinder in an amount corresponding to the estimated intake air amount, at a point in time prior to closing of the intake valve 32. In this embodiment, the time of completion of fuel injection is set to 75° crank angle before the top dead center of the suction stroke of the fuel injection cylinder (which is expressed as "BTDC 75° CA"). The expression using BTDC may be similarly used for other crank angles. With the time of completion of injection thus determined, the control apparatus of this embodiment estimates the intake air amount of the fuel injection cylinder at a point in time prior to BTDC 75°, in view of the time required for injection (i.e., the opening duration of the injector 39) and the calculating time of the CPU 71.

In the meantime, the intake pipe pressure (namely, the pressure of the air in the intake pipe) measured at the time of closing of the intake valve 32 has a close relationship with the intake air amount. Also, the intake pipe pressure measured at the time of closing of the intake valve 32 depends upon the throttle opening measured at the time of closing of the intake valve 32. Thus, the control apparatus estimates the throttle opening for the time of closing of the intake valve, and estimates in advance the intake air amount KLfwd of the fuel injection cylinder based on the throttle opening. The control apparatus then determines a provisional necessary fuel amount (pre-correction estimated necessary fuel amount) Fcfwdb by dividing the estimated intake air amount KLfwd by a target air/fuel ratio AbyFref separately determined depending upon the engine operating conditions, while separately obtaining a fuel feedback correction amount Ffb, and determines a normal estimated necessary fuel amount Fcfwd by correcting the pre-correction estimated necessary fuel amount Fcfwdb with the fuel feedback correction amount Ffb, as indicated in the expression (1) below. As will be explained in detail later, the fuel feedback correction amount Ffb is determined based on a difference between the amount of fuel (actual necessary fuel amount) that was actually needed in the previous suction stroke and the amount of fuel (actual intake fuel amount) that was actually drawn or inducted into the cylinder in the previous suction stroke. The control apparatus then calculates the fuel injection amount fi based on the normal estimated necessary fuel amount Fcfwd, so that fuel of the normal estimated necessary fuel amount Fcfwd is drawn into the cylinder if the fuel of the fuel injection amount fi is injected from the injector into the intake passage. In this manner, the fuel injection amount (i.e., the final amount of injected fuel) fi is determined.

$$Fcfwd=KLfwd/AbyFref+Ffb=Fcfwdb+Ffb \quad (1)$$

Specific Arrangement and Functions

The specific arrangement and functions of the fuel injection amount control apparatus for calculating the fuel injection amount fi will be hereinafter described. As indicated in the function block diagram of FIG. 5, the fuel injection amount control apparatus includes an electronically controlled throttle valve logic A1, an operating state quantity acquiring unit A2, an operating state quantity estimating unit M1, a first intake air model A3, a second intake air model A4, a target air/fuel ratio setting unit A5, and an injection amount determining unit A6 as shown in detail in the function block diagram of FIG. 6. The operating state quantity acquiring unit A2 acquires operating state quantities, such as an actual throttle opening and an actual accelerator operation amount, of the engine, which were measured at points in time prior to the present time. The operating state quantity estimating unit M1 estimates operating state quantities, such as a throttle opening, of the engine, which will be established at points in time ahead of the present time. The first intake air model A3 serves as an actual intake air amount calculating unit, and includes an air model that models the behavior of the air in the intake system of the engine. The second intake air model A4 serves as an estimated intake air amount calculating unit, and includes the same air model. In the following, each of the units and models will be individually described.

Electronically Controlled Throttle Valve Logic and Electronically Controlled Throttle Valve Model Initially, the electronically controlled throttle valve logic A1 for controlling the opening angle of the throttle valve and the electronically controlled throttle valve model M1 for estimating the throttle opening TAest to be established in the future (i.e., at a time point ahead of the present time) will be described.

Figure 7:
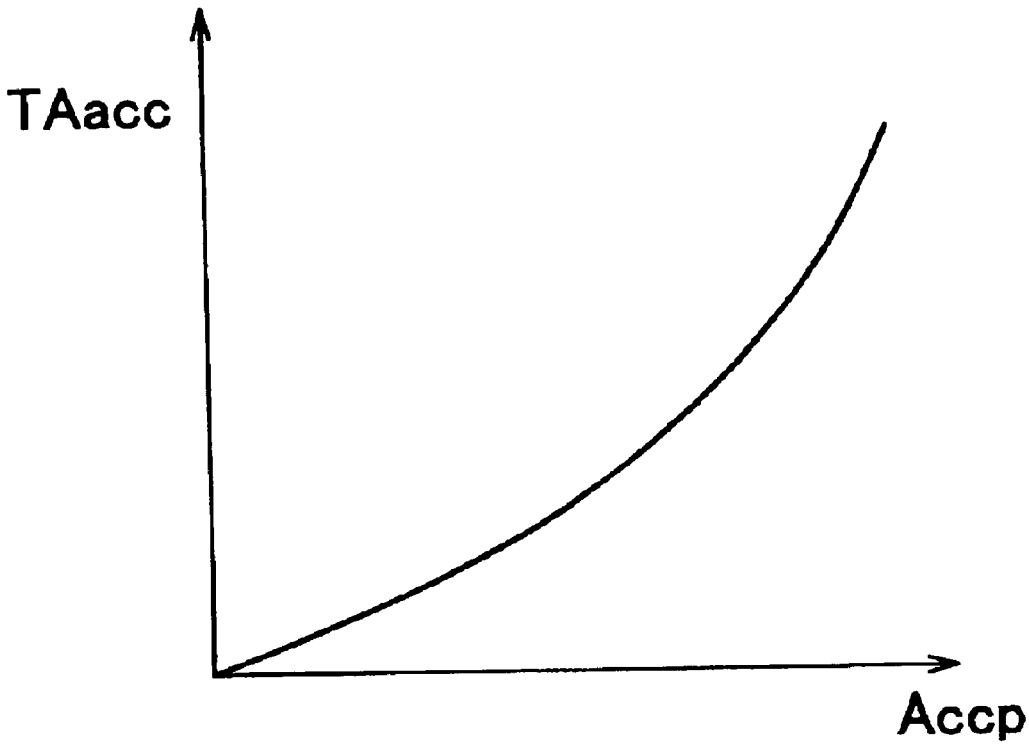
FIG. 7 is a graph representing a table that defines the relationship between the accelerator pedal operation amount read by the CPU shown in FIG. 1, and a provisional target throttle opening.

The electronically controlled throttle valve logic A1 initially reads an accelerator operation amount Accp based on an output value of the accelerator position sensor 81 upon each lapse of a computation period ΔTt (e.g., 8 msec), and determines a provisional target throttle opening TAacc of this cycle, based on the accelerator operation amount Accp thus read, and the table of FIG. 7 that defines the relationship between the accelerator operation amount Accp and the target throttle opening TAacc. The provisional target throttle opening TAacc is then delayed by a predetermined delay time TD as shown in the time chart of FIG. 8, and the delayed provisional target throttle opening TAacc is set as a target throttle opening TAt, which is then output to the throttle valve actuator 43*a*. While the delay time TD is a fixed time in this embodiment, the delay time TD may be a variable time that depends upon the engine speed NE. For example, the delay time TD may be set to time T270 required for the engine to rotate a predetermined crank angle (e.g., crank angle of 270° CA).

Figure 8:
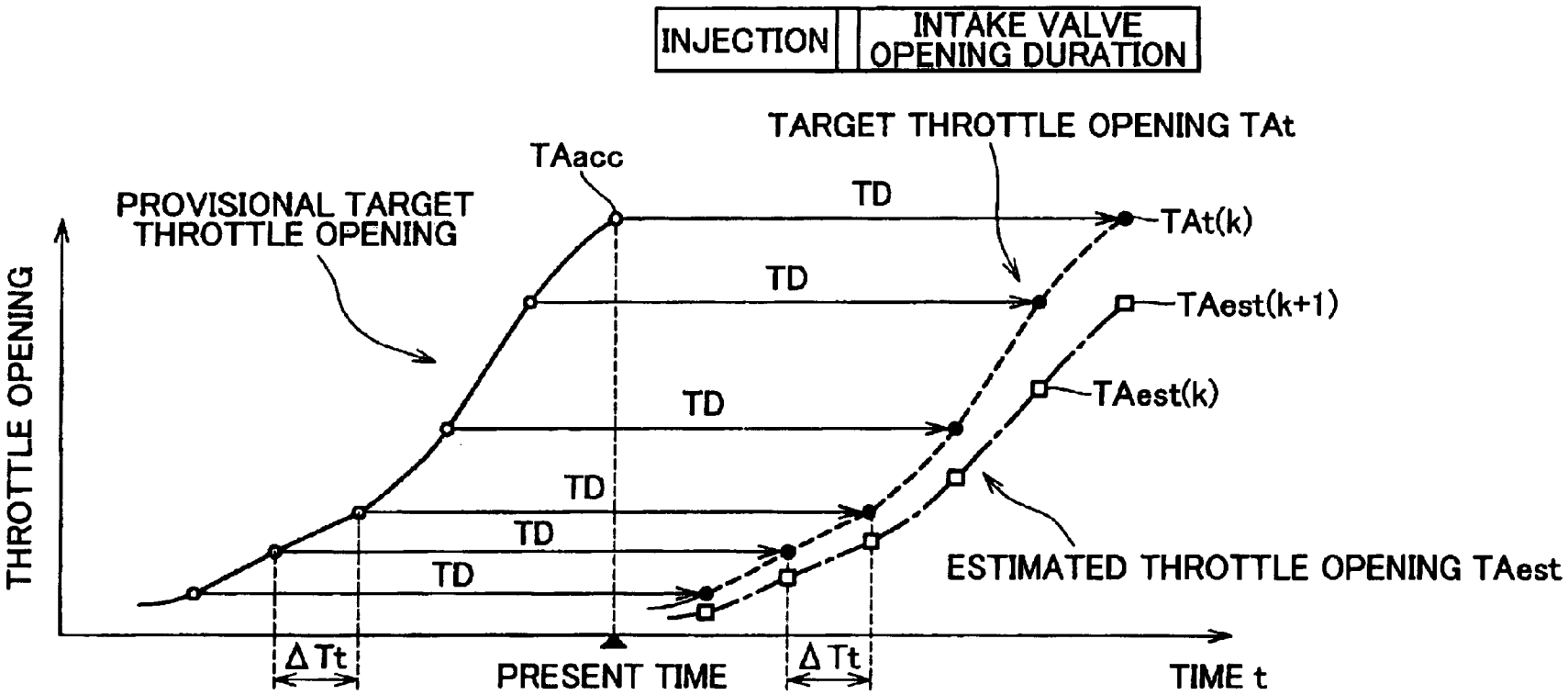
FIG. 8 is a time chart showing changes in the provisional target throttle opening, a target throttle opening and an estimated throttle opening.

When the target throttle opening TAt is generated from the electronically controlled throttle valve logic A1 to the throttle valve actuator 43*a*, the actual throttle opening TA follows the target throttle opening TAt with a certain delay due to, for example, a delay in the throttle valve actuator 43*a* and the inertia of the throttle valve 43. Thus, the electronically controlled throttle valve model M1 estimates the throttle opening to be established the delay time TD later (as shown in FIG. 8), according to the following expression (2).

$$TAest(k+1)=TAest(k)+\Delta Tr\cdot f(TAt(k),TAest(k)) \quad (2)$$

Figure 9:
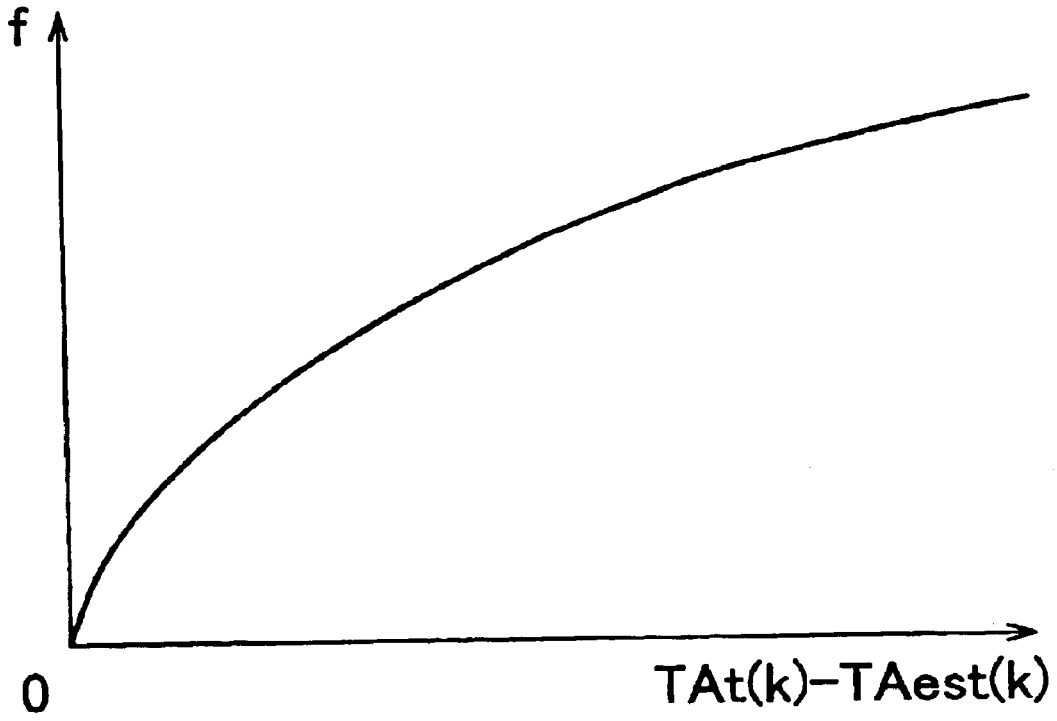
FIG. 9 is a graph showing a function used in calculation of the estimated throttle opening.

In the above expression (2), TAest(k+1) is estimated throttle opening TAest that is newly estimated in the current cycle (or computation timing), and TAt(k) is target throttle opening TAt that is newly obtained in the current cycle, while TAest(k) is the latest estimated throttle opening TAest that has already been available in the current cycle (namely, the throttle opening TAest that was estimated in the previous cycle). Also, the function f(TAt(k), TAest(k)) takes the larger value as a difference ΔTA(=TAt(k)−TAest(k)) between TAt (k) and TAest(k) is larger, as shown in FIG. 9. Namely, the result of the function f monotonously increases with the difference ΔTA.

As described above, the electronically controlled throttle valve model M1 (CPU 71) newly determines the target throttle valve opening TAt to be established upon a lapse of the delay time TD and newly estimates the throttle opening TAest to be established upon a lapse of the delay time TD, in the current cycle (or computation timing). By repeating the above process, the CPU 71 successively stores the target throttle opening TAt and the estimated throttle opening TAest from the present time to the point of the lapse of the delay time TD in the RAM 73, such that these values TAt, TAest vary with time measured from the present time.

First Intake Air Model (Actual Intake Air Amount Calculating Unit) A3

Figure 5:
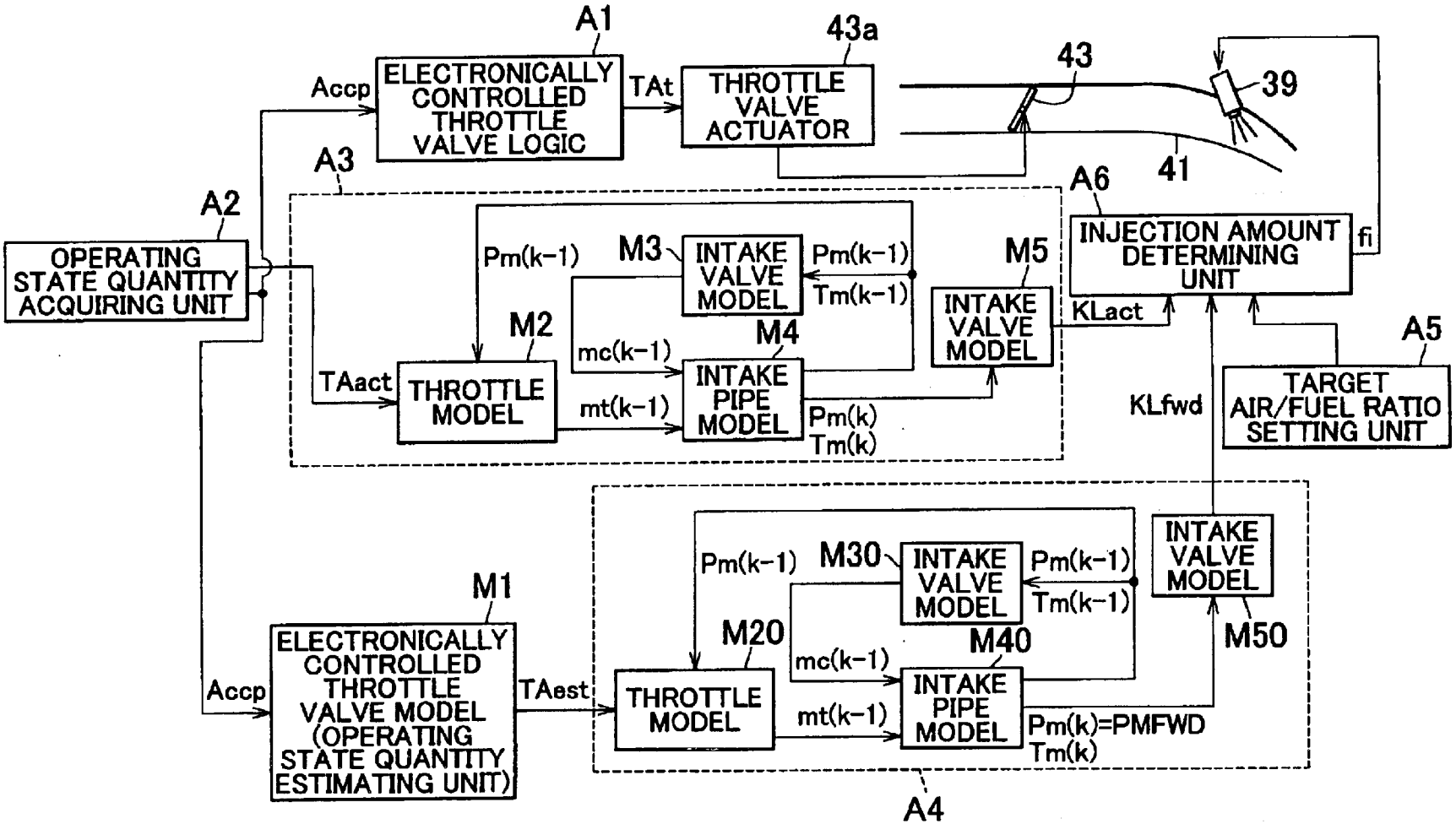
FIG. 5 is a function block diagram showing various logics and various models for determining the fuel injection amount while controlling the opening angle of a throttle valve of the engine shown in FIG. 1.

As shown in FIG. 5, the first intake air model A3 includes a throttle model M2, an intake valve model M3, an intake pipe model M4 and an intake valve model M5, which constitute an air model that models the behavior of the air in the intake system of the engine. This model A3 calculates the actual intake air amount KLact that is the actual amount of intake air present in a particular cylinder at the time of closing of the intake valve in the previous suction stroke, at a point in time that is later than closing of the intake valve in the previous suction stroke and is earlier than closing of the intake vale in the current or coming suction stroke. The actual intake air amount KLact is calculated based on the actual throttle opening TAact that is the actual operating state quantity acquired by the operating state quantity acquiring unit A2. The contents of the throttle model M2, intake valve model M3, intake pipe model M4 and the intake valve model M5 will be described in detail later.

While the actual intake air amount KLact is calculated by the throttle model M2, intake valve model M3, intake pipe model M4 and the intake valve model M5 in this embodiment, the amount KLact may be determined in another manner. More specifically, the actual intake air amount KLact may be determined by using the actual throttle opening TAact measured at the time of closing of the intake valve in the previous suction stroke of the fuel injection cylinder, the actual engine speed NE measured at the time of closing of the intake valve in the previous suction stroke of the fuel injection cylinder, and a table (which defines the relationship among the throttle opening TAact, the engine speed NE and the actual intake air amount KLact) or a mathematical expression.

Second Intake Air Model A4

As shown in FIG. 5, the second intake air model A4 includes a throttle model M20, an intake valve model M30, an intake pipe model M40 and an intake valve model M50, which constitute an air model similar to the air model included in the first intake air model A3. This model A4 estimates the intake air amount (estimated intake air amount) KLfwd for the time of closing of the intake valve in the current or coming suction stroke of the fuel injection cylinder, based on at least the estimated throttle opening TAest estimated by the electronically controlled throttle valve model M1. The contents of the throttle model M20, intake valve model M30, intake pipe model M40 and the intake valve model M50 will be described in detail later.

The second air model A4 may be arranged to determine the estimated intake air amount KLfwd for the time of closing of the intake valve in the current or coming suction stroke, by using the estimated throttle opening TAest for the time of closing of the intake valve in the current or coming suction stroke of the fuel injection cylinder, the actual engine speed NE measured at the time of closing of the intake valve in the current suction stroke of the fuel injection cylinder, and a table (which defines the relationship among the throttle opening TA, the engine speed NE and the intake air amount).

Target Air/Fuel Ratio Setting Unit A5

The target air/fuel ratio setting unit A5 determines the target air/fuel ratio AbyFref based on the engine speed NE as an operating condition of the engine, target throttle opening TAt and so forth. For example, the target air/fuel ratio AbyFref may be set to the stoichiometric air/fuel ratio after completion of warm-up of the engine, except in special cases.

Injection Amount Determining Unit A6

The injection amount determining unit A6 shown in FIG. 5 determines the fuel injection amount fi(k) for the current or coming suction stroke of a particular cylinder, based on the actual intake air amount KLact (the actual amount of the intake air present in the cylinder at the time of closing of the intake vale in the previous suction stroke of the cylinder) calculated by the first intake air model A3, the estimated intake air amount KLfwd (the amount of the intake air that will be present in the cylinder at the time of closing of the intake valve in the current or coming suction stroke of the cylinder) calculated by the second intake air model A4, the target air/fuel ratio AbyFref determined by the target air/fuel ratio setting unit A5, and so forth. As shown in detail in FIG. 6, the injection amount determining unit A6 includes a pre-correction estimated necessary fuel amount calculating unit A51, an actual necessary fuel amount calculating unit A52, an actual intake fuel amount calculating unit (fuel behavior forward model) A53, a fuel feedback correction amount calculating unit A54, a normal estimated necessary fuel amount calculating unit A55 and a fuel injection amount calculating unit (fuel behavior reverse model) A56. In the following, each of the units and models included in the fuel injection amount determining unit A6 will be individually described.

Pre-Correction Estimated Necessary Fuel Amount Calculating Unit A51

The pre-correction estimated necessary fuel amount calculating unit A51 calculates the pre-correction estimated necessary fuel amount Fcfwdb by dividing the estimated intake air amount KLfwd for the time of closing of the intake valve in the current or coming suction stroke of the particular cylinder, which is calculated by the second intake air model A4, by the target air/fuel ratio AbyFref calculated by the target air/fuel ratio setting unit A5 (KLfwd/AbyFref). Namely, the pre-correction estimated necessary fuel amount Fcfwdb is an amount of fuel that is required for making the air/fuel ratio of an air-fuel mixture to be drawn into the cylinder in the current or coming suction stroke of the particular cylinder equal to the target air/fuel ratio AbyFref.

Actual Necessary Fuel Amount Calculating Unit A52

The actual necessary fuel amount calculating unit A52 divides the actual intake air amount KLact (the actual amount of the intake air present in the cylinder at the time of closing of the intake valve in the previous suction stroke of the particular cylinder) obtained by the first intake air model A3, by the target air/fuel ratio AbyFref set by the target air/fuel ratio setting unit A5 (KLact/AbyFref), so as to determine the actual necessary fuel amount Fcact that is an amount of fuel required for making the air/fuel ratio equal to the target air/fuel ratio AbyFref in the previous suction stroke of the particular cylinder.

Actual Intake Fuel Amount Calculating Unit (Fuel Behavior Forward Model) A53

The actual intake fuel amount calculating unit A53 determines the actual intake fuel amount Fcest that is an amount of fuel actually inducted into the cylinder in the previous suction stroke of the cylinder, by using the forward model of the fuel behavior. Namely, the actual intake fuel amount Fcest is determined in view of the amount of fuel that was drawn into the cylinder without adhering to the intake system, out of the fuel (of the previous fuel injection amount fi(k−1)) actually injected for the previous suction stroke of the particular cylinder, and the amount of fuel that had been deposited on the intake system and was drawn into the cylinder during the previous suction stroke.

The fuel behavior forward model will be now explained. A port fuel deposition amount fwp(k) that is an amount of fuel actually deposited in the intake port of the particular cylinder at a point in time after the previous suction stroke of the cylinder and immediately before the current suction stroke and a valve fuel deposition amount fwv(k) that is an amount of fuel actually deposited on the intake valve of the cylinder at this point of time are determined according to the following expressions (3) and (4) as indicated below. In these expressions (3), (4), fwp(k−1) represents a port fuel deposition amount that is an amount of fuel deposited in the intake port of the cylinder at a point after the second previous suction stroke of the cylinder and immediately before the previous suction stroke, and fwv(k−1) represents a valve fuel deposition amount that is an amount of fuel deposited on the intake vale of the cylinder at this point in time. Also, Rp is a fuel deposition rate at which the fuel is deposited in the intake port, Rv is a fuel deposition rate at which the fuel is deposited on the intake valve, Pp is a fuel remaining rate at which the fuel remains in the intake port, and Pv is a fuel remaining rate at which the fuel remains on the intake valve. The following expressions (3) and (4) correspond to an actual fuel deposition amount calculating unit.

$$fwp(k)=Pp\cdot fwp(k-1)+Rp\cdot fi(k-1) \quad (3)$$

$$fwv(k)=Pv\cdot fwv(k-1)+Rv\cdot fi(k-1) \quad (4)$$

The actual intake fuel amount Fcest that is the amount of fuel actually drawn into the cylinder during the previous suction stroke of the particular cylinder is calculated according to the following expression (5). This expression (5) represents the fuel behavior forward model.

$$Fcest=(1\cdot Pp)\cdot fwp(k-1)+(1\cdot Pv)\cdot fwv(k-1)+(1-Rp-Rv)\cdot fi(k-1) \quad (5)$$

The actual intake fuel amount calculating unit A53 determines the intake-port fuel deposition rate Rp, the intake-valve fuel deposition rate Rv, the intake-port fuel remaining rate Pp and the intake-valve fuel remaining rate Pv, based on the actual amount KLact of the intake air present in the cylinder at the time of closing of the intake valve in the previous suction stroke (or the actual throttle opening at the time of closing of the intake valve), the actual engine speed NE detected at the time of closing of the intake valve (which may be the engine speed NE detected at the time of calculation of the actual intake air amount KLact), the actual intake valve opening/closing timing VT detected at the time of closing of the intake valve (which may be the intake valve opening/closing timing VT detected at the time of calculation of the actual intake air amount KLact), and so forth. The actual intake fuel amount Fcest is calculated with respect to each cylinder, based on the deposition rates and remaining rates thus determined, and the above-indicated expressions (3)–(5).

Fuel Feedback Correction Amount Calculating Unit A54

The fuel feedback correction amount calculating unit A54 calculates the fuel feedback correction amount Ffb(k), based on an intake fuel amount error Fcerr(k), namely, "a difference between the actual necessary fuel amount Fcact and the actual intake fuel amount Fcest" that represents an excess or shortage of the fuel in the previous suction stroke of the particular cylinder. In this embodiment, the fuel feedback correction amount calculating unit A54, which is a PI (proportional-integral) controller, calculates the intake fuel amount error Fcerr(k) according to the following expression (6), and calculates the fuel feedback correction amount Ffb(k) according to the following expressions (7) and (8). In the expressions (7) and (8), SumFcerr is an integral value of the intake fuel amount error Fcerr, and coefficients Kp and Ki are a proportional constant and an integration constant, respectively. The coefficients Kp and Ki need not be changed after once determined in a design stage of the PI controller.

$$Fcerr(k)=Fcact-Fcest \quad (6)$$

$$Ffb(k)=Kp\cdot Fcerr(k)+Ki\cdot SumFcerr(k-1) \quad (7)$$

$$SumFcerr(k)=SumFcerr(k-1)+Fcerr(k) \quad (8)$$

Normal Estimated Necessary Fuel Amount Calculating Unit A55

The normal estimated necessary fuel amount calculating unit A55 calculates the normal estimated necessary fuel amount Fcfwd(k) of the particular cylinder, by correcting the pre-correction estimated necessary fuel amount Fcfwdb(k) obtained as described above, by using the fuel feedback correction amount Ffb(k). More specifically, the normal estimated necessary fuel amount Fcfwd(k) is calculated by adding the fuel feedback correction amount Ffb(k) to the pre-correction estimated necessary fuel amount Fcfwdb(k), as indicated in the following expression (9) similar to the above-indicated expression (1).

$$Fcfwd(k)=Fcfwdb(k)+Ffb(k) \quad (9)$$

Fuel Injection Amount Calculating Unit (Fuel Behavior Reverse Model) A56

The fuel injection amount calculating unit A56 calculates the fuel injection amount fi(k) for the current or coming suction stroke, which is required for supplying the fuel of the normal estimated necessary fuel amount Fcfwd(k) into the fuel injection cylinder, by using the reverse model of the fuel behavior. Namely, the fuel injection amount fi(k) is calculated in view of the amount of fuel drawn into the cylinder without adhering to the intake system including the intake port and the intake valve, out of the injected fuel, and the amount of fuel drawn into the cylinder in this suction stroke, out of the fuel that has been deposited on the intake system.

The reverse model of the fuel behavior model will be now explained. Assuming that the fuel of the fuel injection amount fi(k) is injected for the current or coming suction stroke of a particular cylinder, the amount Fin of fuel drawn into the cylinder is expressed by the following expression (10). In this expression (10), the port fuel deposition amount fwp(k), which has already been obtained according to the expression (3) used by the actual intake fuel amount calculating unit (fuel behavior forward model) A53, is an amount of fuel actually deposited in the intake port of the cylinder after the previous suction stroke of the cylinder and immediately before the current or coming suction stroke, and the valve fuel deposition amount fwv(k), which has already been obtained according to the expression (4) used by the same unit A53, is an amount of fuel actually deposited on the intake vale of the cylinder at this time. In the expression (10), Rpf is a fuel deposition rate at which the fuel is deposited in the intake port, Rvf is a fuel deposition rate at which the fuel is deposited on the intake valve, Ppf is a fuel remaining rate at which the fuel remains in the intake port, and Pvf is a fuel remaining rate at which the fuel remains on the intake valve.

$$Fin=(1-Rpf-Rvf)\cdot fi(k)+(1-Ppf)\cdot fwp(k)+(1-Pvf)\cdot fwv(k) \quad (10)$$

In order to introduce the fuel of the normal estimated necessary fuel amount Fcfwd(k) into the particular cylinder in the current or coming suction stroke of the cylinder, the fuel injection amount fi(k) is calculated by replacing the fuel amount Fin by the normal estimated necessary fuel amount Fcfwd(k) in the above expression (10) and solving the expression (10) with respect to fi(k). The result of calculation is indicated in the following expression (11), which is a mathematical expression of the reverse model of the fuel behavior.

$$fi(k)=(Fcfwd(k)-(1-Ppf)\cdot fwp(k)-(1-Pvf)\cdot fwv(k))/(1-Rpf-Rvf) \quad (11)$$

The fuel injection amount calculating unit A56 calculates the intake-port fuel deposition rate Rpf, the intake-valve fuel deposition rate Rvf, the intake-port fuel remaining rate Ppf and the intake-valve fuel remaining rate Pvf, based on the estimated intake air amount KLfwd for the time of closing of the intake valve (or the estimated throttle opening TAest for the time of closing of the valve), the estimated engine speed NE for the time of closing of the intake valve, the estimated intake valve opening/closing timing VT for the time of closing of the intake valve, and so forth. The engine speed NE detected at the time of the calculation of the estimated intake air amount KLfwd may be used in place of the estimated engine speed NE where the engine speed NE changes only by a small amount in a short time. Also, the intake valve opening/closing timing VT detected at the time of calculation of the estimated intake. air amount KLfwd may be used in place of the estimated intake valve opening opening/closing timing VT where the timing VT changes only by a small amount in a short time. The fuel injection amount calculating unit A56 then calculates the fuel injection amount fi(k) by using the fuel deposition and remaining rates thus determined, and the above-indicated expression (11).

Figure 10:
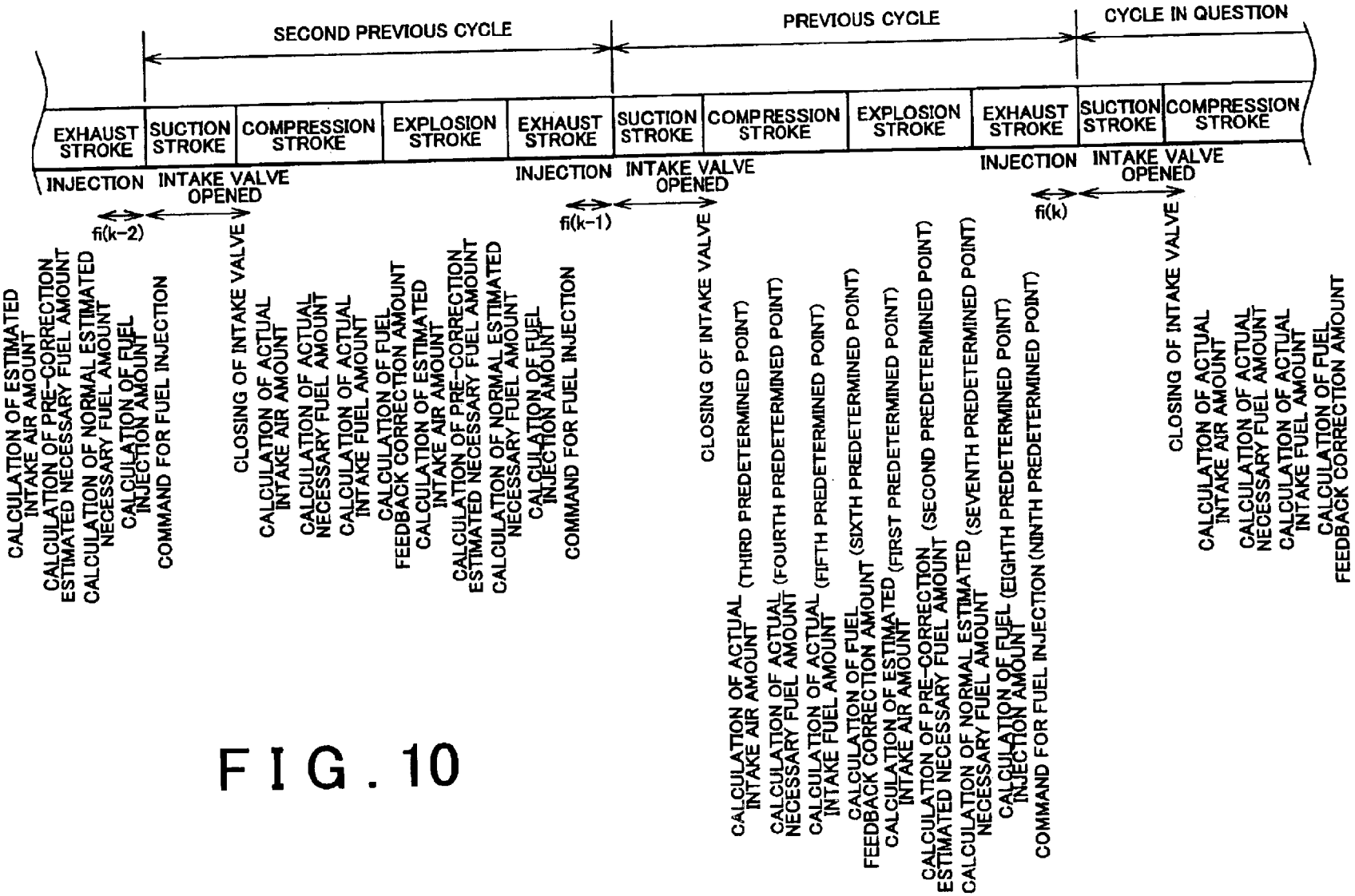
FIG. 10 is a view showing the timing of calculation by respective function blocks provided in the injection amount determining unit shown in FIG. 6.

The calculation timing of each unit of the injection amount determining unit A6 will be explained with reference to FIG. 10 that indicates the respective strokes of a particular cylinder and the calculation timing. FIG. 10 illustrates the case where the injection amount fi(k) employed in fuel injection A for the coming suction stroke A is to be determined. Initially, the first intake air model A3 calculates the actual intake air amount KLact at a point in time (third predetermined point) that is later than the closing time B of the intake valve in the previous suction stroke B and is earlier than the closing time A of the intake valve in the coming suction stroke A. In the case where fuel is supplied through fuel injection A for the coming suction stroke A, the third predetermined point in time is preferably earlier than a start of the fuel injection A.

Subsequently, the actual necessary fuel amount calculating unit A52 calculates the actual necessary fuel amount Fcact, which is the amount of fuel actually required to be drawn into the cylinder during the previous suction stroke B of the cylinder, based on the calculated actual intake air amount KLact, at a point in time (fourth predetermined point) that is later than the third predetermined point and is earlier than the closing time A of the intake valve in the coming suction stroke A of the cylinder.

Then, the actual intake fuel amount Fcest, which is the amount of fuel actually drawn into the cylinder during the previous suction stroke, is calculated based on the fuel injection amount fi(k−1) as the amount of fuel actually injected for the previous suction stroke of the cylinder, at a fifth predetermined point in time that is earlier than the closing time A of the intake valve in the coming suction stroke A and is later than the time when the fuel injection amount for the previous suction stroke B was determined (for example, the time of calculation of the previous fuel injection amount fi(k−1)).

At a sixth predetermined point in time that is later than the fourth and fifth predetermined points and is earlier than the closing time A of the intake valve in the coming suction stroke A, the fuel feedback correction amount calculating unit A54 calculates the fuel feedback correction amount Ffb(k), based on the calculated actual necessary fuel amount Fcact and the calculated actual intake fuel amount Fcest.

On the other hand, at a first predetermined point in time prior to the closing time A of the intake valve in the coming suction stroke A of the particular cylinder, the estimated intake air amount calculating unit A4 calculates the estimated intake air amount KLfwd as the amount of intake air that will be present in the cylinder at the closing time A of the intake valve in the coming suction stroke A. While the first predetermined point may be theoretically any point in time prior to the closing time A of the intake valve in the suction stroke A, it is preferable to set the first predetermined point as close to the closing time A of the intake valve as possible so as to enhance the estimation accuracy of the estimated intake air amount KLfwd. In fact, the first predetermined point is preferably set to be immediately before a starting point of the fuel injection A for the coming suction stroke A.

At a second predetermined point in time that is later than the first predetermined point and is earlier than the closing time A of the intake valve in the coming suction stroke A of the cylinder, the pre-correction estimated necessary fuel amount calculating unit A51 calculates the pre-correction estimated necessary fuel amount Fcfwdb(k) as a provisional amount of fuel to be inducted into the cylinder for the coming suction stroke A of the cylinder, based on the estimated intake air amount KLfwd. It is to be understood that the first predetermined point and the second predetermined point may be earlier than the third through fifth predetermined points.

At a seventh predetermined point in time that is later than the second predetermined point and the sixth predetermined point and is earlier than the closing time A of the intake valve in the coming suction stroke A of the cylinder, the normal estimated necessary fuel amount calculating unit A55 calculates the normal estimated necessary fuel amount Fcfwd (k) to be drawn into the cylinder for the coming suction stroke A of the cylinder, by correcting the calculated pre-correction estimated necessary fuel amount Fcfwdb(k) with the calculated fuel feedback correction amount Ffb(k).

At an eighth predetermined point in time that is later than the seventh predetermined point and is earlier than the closing time A of the intake valve in the coming suction stroke A, the fuel injection amount fi(k) as the amount of fuel to be injected for the coming suction stroke of the cylinder is calculated based on the normal estimated necessary fuel amount Fcfwd(k). At a ninth predetermined point in time that is later than the eighth predetermined point and is earlier than the closing time A of the intake valve in the coming suction stroke A, a command to inject fuel in the fuel injection amount fi(k) is generated, and fuel injection A is carried out in response to the command. The above-described operations are performed between a certain suction stroke of one cylinder and the next or following suction stroke of the same cylinder.

Next, the first intake air model A3 and the second intake air model A4 as described above will be explained in detail. As shown in FIG. 5, the first intake air model A3 includes the models M2–M5. The second intake air model A4 includes the models M20–M50 corresponding to the models M2–M5, respectively, and is different from the first intake air model A4 only in terms of parameters received by the models. In the following description, therefore, the first intake air model A3 will be mainly explained, and the second intake air model A4 will be explained only in respect of differences from the first intake air model A3.

Throttle Model M2

The throttle model M2 estimates the flow rate mt of air that passes the throttle valve 43 (which will be called "throttle passing air flow rate"), based on the following expression (12) obtained based on physical laws, such as the law of conservation of energy, the law of conservation of momentum, the law of conservation of mass, and the equation of state. In the expression (12), Ct(θt) is flow coefficient that varies depending upon the throttle opening θt (=TA), At(θt) is area of the opening of the throttle valve 43 (the opening area of the intake pipe 41) that varies depending upon the throttle opening θt (=TA), Pa is pressure measured upstream of the throttle valve 43 (namely, an atmospheric pressure), Pm is intake pipe pressure (a pressure of the air in the intake pipe 41), Ta is intake air temperature (the atmospheric temperature), Tm is temperature of the air in the intake pipe 41, R is gas constant, and 78 is ratio of specific heat (κ is handled as a constant value).

$$mt = Ct(\theta t)At(\theta t)Pa\sqrt{\frac{\kappa+1}{2\kappa RTa}}\sqrt{\left(\frac{\kappa}{\kappa+1}\right)^2-\left(\frac{Pm}{Pa}-\frac{1}{\kappa+1}\right)^2} \quad (12)$$

Here, the process of deriving the above-indicated expression (12) that describes the throttle model M2 will be described. The throttle passing air flow rate mt is expressed by the following expression (13), which describes the law of conservation of mass, where Au is cross-sectional area of the opening upstream of the throttle valve 43, ρu is air density, vu is flow rate of the air, Ad is cross-sectional area of the opening of the intake pipe 41 downstream of the throttle valve 43, ρd is air density measured at the same location, and vd is flow rate of the air passing the throttle valve 43.

$$mt=Ad\cdot\rho d\cdot vd=Au\cdot\rho u\cdot vu \quad (13)$$

On one hand, the kinetic energy is expressed as $m\cdot vu^2/2$ (where $m^{-1}$ is mass of the air) when measured at a location upstream of the throttle valve 43, and is expressed as $m\cdot vd^2/2$ when measured at a location where the air passes the throttle valve 43. On the other hand, the thermal energy is expressed as m·Cp·Tu (where Tu is temperature of the air upstream of the throttle valve 43, and Cp is specific heat at a constant pressure) when measured at the location upstream of the throttle valve 43, and is expressed as m·Cp·Td (where Td is temperature of the air downstream of the throttle valve 43) when measured at the location where the air passes the throttle valve 43. Accordingly, the following expression (14) is obtained according to the law of conservation of energy.

$$m\cdot vu^2/2+m\cdot Cp\cdot Tu=m\cdot vd^2/2+m\cdot Cp\cdot Td \quad (14)$$

Since the equation of state is represented by an expression (15) as indicated below, and the ratio of specific heat κ is represented by an expression (16) below while the Mayer's relationship is represented by an expression (17) below, Cp·T is expressed by an expression (18) below, which is derived from the expressions (15)–(17). In the following expressions, P is gas pressure, ρ is gas density, T is gas temperature, R is gas constant, and Cv is specific heat at a constant volume.

$$P=\rho\cdot R\cdot T \quad (15)$$

$$\kappa=Cp/Cv \quad (16)$$

$$Cp=Cv+R \quad (17)$$

$$Cp\cdot T=\{\kappa/(\kappa-1)\}\cdot(P/\rho) \quad (18)$$

The following expression (19) is obtained by rewriting the above expression (14) based on the law of conservation of energy, by using the relationship of the above expression (18). In the expression (19), Pu is air pressure measured at a location upstream of the throttle valve 43, and Pd is air pressure measured at a location downstream of the throttle valve 43 (i.e., the intake pipe pressure Pm).

$$vu^2/2+\{\kappa/(\kappa-1)\}\cdot(Pu/\rho u)=vd^2/2+\{\kappa/(\kappa-1)\}\cdot(Pd/\rho d) \quad (19)$$

If the infinite upstream of the throttle valve 43 is taken into consideration, Au=∞ and vu=0, and therefore the above-indicate expression (19) based on the law of conservation of energy is rewritten into the following expression (20).

$$\{\kappa/(\kappa-1)\}\cdot(Pu/\rho u)=vd^2/2+\{\kappa/(\kappa-1)\}\cdot(Pd/\rho d) \quad (20)$$

Next, the momentum will be described. Where Pu is pressure applied to a portion having the cross-sectional area Au, Pd is pressure applied to a portion having the cross-sectional area Ad, and Pmean is mean pressure of the fixed space between the portion of the cross-sectional area Au and the portion of the cross-sectional area Ad, the following expression (21) is obtained.

$$\rho d \cdot vd^2 \cdot Ad - \rho u \cdot vu^2 \cdot Au = Pu \cdot Au - Pd \cdot Ad + P\text{mean} \cdot (Ad - Au) \quad (21)$$

Since an expression (22) as indicated below is obtained if Au=∞ and vu=0 in the above expression (21), a relationship associated with the momentum (i.e., a relationship based on the law of conservation of momentum) as indicated in an expression (23) below is derived from the expressions (22) and (21).

$$P\text{mean} = Pu \quad (22)$$

$$\rho d \cdot vd^2 = Pu - Pd \quad (23)$$

Accordingly, the following expression (24) is derived from the above-indicated expressions (13), (20) and (23).

$$mt = AD\sqrt{Pu \cdot \rho u}\sqrt{\left(\frac{Pd}{Pu} + \frac{1}{2}\frac{\kappa - 1}{\kappa}\left(1 - \frac{Pd}{Pu}\right)\right)\left(1 - \frac{Pd}{Pu}\right)} \quad (24)$$

In the above expression (24), Pu is the pressure Pa measured at a location upstream of the throttle valve 43, and Pd is the intake pipe pressure Pm. If the above expression (24) is rewritten by substituting ρu=M/Vu=Pu/(R·Tu) into the above expression (24) according to the equation of state, replacing the opening cross-sectional area Ad by the opening area A(θt), and adding the flow coefficient Ct(θt), the above-indicated expression (12) is obtained.

Next, a method of calculating the throttle passing air flow rate mt by the throttle model M2 will be described. The above-indicated expression (12) is rewritten into the following expressions (25) and (26), and the expression (25) is rewritten into the following expression (27) where k1 is $Ct(\theta t) \cdot At(\theta t) \cdot \{Pa/(R \cdot Ta)^{1/2}\}$, and mts is the throttle passing air flow rate at the time of closing of the intake valve.

$$mt = Ct(\theta t) \cdot At(\theta t) \cdot \{Pa/(R \cdot Ta)^{1/2}\} \cdot \Phi(Pm/Pa) \quad (25)$$

$$\Phi(Pm/Pa) = \sqrt{\frac{\kappa + 1}{2\kappa}}\sqrt{\left(\frac{\kappa}{\kappa + 1}\right)^2 - \left(\frac{Pm}{Pa} - \frac{1}{\kappa + 1}\right)^2} \quad (26)$$

$$mts = k1 \cdot \Phi(Pm/Pa) \quad (27)$$

The following expression (28) is obtained if mts used in the above expression (27) is replaced by mtsTA that represents the throttle passing air flow rate obtained in the case where the engine 10 is in a steady state (i.e., where the throttle opening is kept substantially constant until the intake valve is closed), and Pm used in the expression (27) is replaced by PmTA that represents the intake pipe pressure in the same engine operating state. By eliminating the coefficient k1 from the expressions (27) and (28), the following expression (29) is obtained.

$$mtsTA = k1 \cdot \Phi(PmTA/Pa) \quad (28)$$

$$mts = \{mtsTA/\Phi(PmTA/Pa)\} \cdot \Phi(Pm/Pa) \quad (29)$$

The value mtsTA on the right side of the expression (29) is associated with the intake air flow rate (throttle passing air flow rate) in a steady operating state in which the throttle opening TA is substantially constant. In the steady operating state, the throttle passing air flow rate mt is equal to an in-cylinder intake air flow rate (i.e., the flow rate of the intake air drawn into the cylinder) mc. Thus, the throttle model M2 calculates the in-cylinder intake air flow rate mc established at a point in time earlier than the present time by the computation period ΔTt, by using an expression (expression (30) as indicated below) obtained according to empirical rules and used in the intake valve model M3 as described later, and sets this value mc to mtsTA. All of the parameters, such as the engine speed NE and the intake valve opening/closing timing VT, used in the calculation of the value mtsTA (=in-cylinder intake air flow rate mc) are the actual values detected at a point in time that is earlier than the present time by the computation period ΔTt.

The throttle model M2 stores in the ROM 72 a table MAPPM that defines the relationships between the throttle opening TA, the engine speed NE and the intake valve opening/closing timing VT, and the intake pipe pressure Pm. The throttle model M2 determines the intake pipe pressure PmTA (=MAPPM (TAact(k−1), NE, VT) on the right side of the above expression (29), based on the actual throttle opening TAact(k−1) detected at a point in time prior to the present time by the computation period ΔTt, the actual engine speed detected at the point prior to the present time by the computation period ΔTt, the actual intake valve opening/closing timing VT detected at the point prior to the present time by the computation period ΔTt, and the table MAPPM.

Furthermore, the throttle model M2 stores a table MAPΦ that defines the relationship between the value Pm/Pa and the value Φ(Pm/Pa), and determines the value Φ(PmTA/Pa) (=MAPΦ (PmTA/Pa)) on the right side of the above expression (29), from the value (PmTA/Pa) obtained by dividing the intake pipe pressure PmTA by the throttle valve upstream pressure Pa, and the table MAPΦ. Similarly, the throttle model M2 determines the value Φ(Pm/Pa) (=MAPΦ(Pm(k−1)/Pa) on the right side of the above expression (29), from the value (Pm(k−1)/Pa) obtained by dividing the previous intake pipe pressure Pm(k−1) already calculated by the intake pipe model M4 as described later, by the throttle valve upstream pressure Pa, and the table MAPΦ. In this manner, each factor of the right side of the above expression (29) is determined, and the throttle passing air flow rate mts (=mt (k−1)) is calculated by multiplying these factors.

Intake Valve Model M3

The intake valve model M3 estimates the in-cylinder intake air flow rate mc from the intake pipe pressure Pm, intake pipe temperature Tm (i.e., the temperature Tm in the intake pipe), intake air temperature THA and so forth. Since the pressure in the cylinder at the time of closing of the intake valve can be regarded as the pressure measured at a location upstream of the intake valve 32, namely, the intake pipe pressure Pm at the time of closing of the intake valve, the in-cylinder intake air flow rate mc is proportional to the intake pipe pressure Pm at the time of closing of the intake valve 32. Thus, the intake valve model M3 calculates the in-cylinder intake air flow rate mc according to the following expression (30) based on empirical rules.

$$mc = (THA/Tm) \cdot (c \cdot Pm - d) \quad (30)$$

In the above expression (30), c is proportional coefficient, and d is an amount corresponding to the amount of burned gas that remains in the cylinder. The intake valve model M3 stores in the ROM 72 a table MAPC that defines the relationship between the engine speed NE and the intake valve opening/closing timing VT, and the proportional coefficient c, and a table MAPD that defines the relationship between the engine speed NE and the intake valve opening/closing timing VT, and the burned gas amount d. The intake valve model M3 determines the proportional coefficient c (=MAPC (NE, VT)) and the burned gas amount d (=MAPD (NE, VT)), from the actual engine speed NE detected at a point in time prior to the present time by the computation period ΔTt, the actual intake valve opening/closing timing VT detected at the point prior to the present time by the computation period ΔTt, and the stored tables MAPC, MAPD, respectively. Also, the throttle model M3 applies the latest intake pipe pressure Pm (=Pm(k−1)) at the time of closing of the intake valve and the latest air temperature Tm (=Tm(k−1)) in the intake pipe, which have already been estimated by the intake pipe model M4 as described later at the time of calculation of mc, to the above expression (30), and estimates the in-cylinder intake air flow rate mc (=mc (k−1)) at the time of closing of the intake valve.

Intake Pipe Model M4

The intake pipe model M4 calculates the intake pipe pressure Pm and the air. temperature Tm in the intake pipe, based on the throttle passing air flow rate mt, the throttle passing air temperature Ta (i.e., the intake air temperature THA), and the flow rate mc of the air flowing out of the intake pipe (namely, the in-cylinder intake air flow rate), according to the following expressions (31) and (32) based on the law of conservation of mass and the law of conservation of energy, respectively. In the expressions (31) and (32), Vm is volume of the intake pipe 41 (which will be simply called "intake pipe portion") that extends from the throttle valve 43 to the intake valve 32.

$$d(Pm/Tm)dt=(R/Vm)\cdot(mt-mc) \tag{31}$$

$$dPm/dt=\kappa\cdot(R/Vm)\cdot(mt\cdot Ta-mc\cdot Tm) \tag{32}$$

The intake pipe model M4 acquires the throttle passing air flow rate mt (=mt(k−1)) on the right sides of the above expressions (31), (32) from the throttle model M2, and acquires the in-cylinder intake air flow rate mc (=mc(k−1)) from the intake valve model M3. The intake pipe model M4 then performs calculations based on the expressions (31) and (32), and estimates the latest intake pipe pressure Pm(=Pm (k)) and the air temperature Tm(=Tm(k)) in the intake pipe.

In the following, the process of deriving the above-indicated expressions (31), (32) that describe the intake pipe model M4 will be described. Where M represents the total amount of the air in the intake pipe portion, the rate of change of the total air amount M (i.e., change in the total air amount M with time) is equal to a difference between the throttle passing air flow rate mt corresponding to the amount of the air flowing into the intake pipe portion and the in-cylinder intake air flow rate mc corresponding to the amount of the air flowing out of the intake pipe portion. Therefore, the following expression (33) is obtained based on the law of conservation of mass.

$$dM/dt=mt-mc \tag{33}$$

Thus, the above-indicated expression (31) based on the law of conservation of mass is obtained by eliminating the total air amount M from the above expression (33) and the following expression (34) that represents the equation of state.

$$Pm\cdot Vm=M\cdot R\cdot Tm \tag{34}$$

Next, the law of conservation of energy associated with the intake pipe portion will be studied. Since the volume Vm of the intake pipe portion does not change, most of the energy is supposed to be used for raising the temperature (namely, the kinetic energy can be ignored). The following expression (35) is derived from the fact that a change in the energy M·Cv·Tm of the air in the intake pipe portion with time is equal to a difference between the energy Cp·mt·Ta of the air flowing into the intake pipe portion and the energy Cp·mc·Tm of the air flowing out of the intake pipe portion.

$$d(M\cdot Cv\cdot Tm)/dt=Cp\cdot mt\cdot Ta-Cp\cdot mc\cdot Tm \tag{35}$$

The above-indicated expression (32) is obtained by modifying this expression (35) by using the above expression (16) (κ=Cp/Cv) and the above expression (34) (Pm·Vm=M·R·Tm).

Intake Valve Model M5

The intake valve model M5 includes a model similar to the intake valve model M3. The intake valve model M5 calculates the latest in-cylinder intake air flow rate mc (=mc(k)) by using the latest intake pipe pressure Pm (=Pm (k)) and the air temperature Tm (=Tm(k)) in the intake pipe calculated by the intake pipe model M4, the current engine speed NE, the current intake valve opening/closing timing VT, the above-mentioned maps MAPC and MAPD, and the expression (30) (mc=(THA/Tm)·(c·Pm−d)) based on the empirical rules. Then, the intake valve model M5 calculates the intake air amount KLact by multiplying the in-cylinder intake air flow rate mc thus determined, by the time Tint from opening of the intake valve 32 to closing thereof in the previous suction stroke B. The time Tint is calculated from the engine speed NE. The intake valve model M5 performs the above-described calculations with respect to each cylinder, and outputs the intake air amount KLact determined for each cylinder immediately after closing of the intake valve of the cylinder, to the injection amount determining unit A6, as the actual intake air amount KLact0 of the cylinder in question.

As explained above, the first intake air model A3 calculates the actual intake air amount KLact that is the actual amount of the intake air present in the cylinder at the time of closing of the intake valve in the previous suction stroke B of a particular cylinder, at the third predetermined point in time, based on the actual operation state quantity (i.e., the actual throttle opening TAact) acquired by the throttle position sensor 64 as the operation state quantity acquiring unit A2, and the air model constituted by the models M2–M5, which models the behavior of the air in the intake system of the engine. The third predetermined point is later than the closing time B of the intake valve in the previous suction stroke B of the particular cylinder, and is earlier than the closing time A of the intake valve in the current (or next) suction stroke A of the cylinder. Actually, the third predetermined point is immediately after closing of the intake valve at the end of the suction stroke B.

Second Intake Air Model A4

The second intake air model (second air model) A4 is a model similar to the air model of the first intake air model that models the behavior of the air in the intake system of the engine. The second intake air model A4 includes the throttle model M20, intake valve model M30, intake pipe model M40 and the intake valve model M50. The second intake air model A4 estimates the intake air amount KLfwd for the closing time A of the intake valve in the current or coming suction stroke A. Thus, the second intake air model A4 is different from the first intake air model A3 in that the second intake air model A4 receives the estimated throttle opening TAest estimated by the above-described electronically controlled throttle valve model M1 whereas the first intake air model A3 receives the actual throttle opening TAact.

Throttle Model M20

The throttle model M20 estimates the throttle passing air flow rate mt to be established at a point in time in the future (for example, at a point later than the present time by a predetermined time, e.g., the delay time TD). In this case, too, mtsTA on the right side of the above expression (29) is supposed to be equal to the in-cylinder intake air flow rate mc, and therefore the value mtsTA is calculated according to the above expression (30) used by the intake valve model M30 as described later. Here, values detected at the present time are employed as parameters (engine speed NE and the intake valve opening/closing timing VT) used for calculation of the value mtsTA for the sake of convenience.

The throttle model M20 calculates a period of time from a point immediately before the start of fuel injection (BTDC 90° CA) to the time of closing of the intake valve, based on the engine speed NE, and reads, from the RAM 72, the estimated throttle opening TAest for a point in time later than the present time by a delay time that is substantially equal to the calculated time period, to set the read value to the estimated throttle opening TAest(k−1). Then, the throttle model M20 determines the intake pipe pressure PmTA (=MAPPM (TAest(k−1), NE, VT)) on the right side of the above expression (29), based on the estimated throttle opening TAest(k−1), the actual engine speed NE detected at a point prior to the present time by the computation period ΔTt, the actual intake valve opening/closing timing VT detected at the point prior to the present time by the computation period ΔTt, and the above-mentioned table MAPPM.

Furthermore, the throttle model M20 determines the value Φ(PmTA/Pa) (=MAPΦ(PmTA/Pa)) on the right side of the expression (29), from a value (PmTA/Pa) obtained by dividing the intake pipe pressure PmTA by the throttle valve upstream pressure Pa, and the table MAPΦ. Similarly, the throttle model M20 determines the value Φ(Pm/Pa) (=MAPΦ(Pm(k−1)/Pa)) on the right side of the expression (29), from a value (Pm(k−1)/Pa) obtained by dividing the previous intake pipe pressure Pm(k−1) already determined by the intake pipe model M40 as described later, by the throttle valve upstream pressure Pa, and the table MAPΦ. Since each factor of the right side of the expression (29) is obtained in this manner, the estimated throttle passing air flow rate mts (=mt(k−1)) is obtained by multiplying these factors.

Intake Valve Model M30

The intake valve model M30 calculates the in-cylinder intake air flow rate mc according to the above expression (30) based on the empirical rules. More specifically, the intake valve model M30 determines the proportional coefficient c from the actual engine speed NE, the actual intake valve opening-closing timing VT and MAPC (NE, VT), and determines the burned gas amount d from the actual engine speed NE, the actual intake valve opening/closing timing VT and MAPD (NE, VT). Also, the intake valve model M30 applies the latest intake pipe pressure Pm (=Pm(k−1)) and the latest intake pipe air temperature Tm (=Tm(k−1)) that have already been estimated by the intake pipe model M40 as described later at the time of calculation of mc, to the above-indicated expression (30), so as to estimate the in-cylinder intake air flow rate mc (=mc(k−1)).

Intake Pipe Model M40

The intake pipe model M40 calculates the intake pipe pressure Pm and the intake pipe air temperature Tm from the above-indicated expressions (31) and (32), the throttle passing air flow rate mt calculated by the throttle model M20, the actual throttle passing air temperature Ta (i.e., the intake air temperature THA), and the flow rate mc of the air flowing out of the intake pipe (i.e., the in-cylinder intake air flow rate) which is calculated by the intake valve model M30.

Intake Valve Model M50

The intake valve model M50 is similar to the above-described intake valve model M3□ except in that the parameters received by the model M50 are different from those received by the model M30. The intake valve model M50 calculates the in-cylinder intake air flow rate mc (=mc(k)) by using the latest intake pipe pressure Pm (=Pm(k)) and intake pipe air temperature Tm (=Tm(k)) calculated by the intake pipe model M40, and the expression (30) (mc=(THA/Tm)·(c·Pm·d)) based on the empirical rules. Then, the intake valve model M50 calculates the estimated intake air amount KLfwd by multiplying the in-cylinder intake air flow rate mc thus determined, by the time Tint required for the suction stroke (i.e., the time from opening of the intake valve 32 to closing thereof). The time Tint is calculated based on the engine speed NE. The intake valve model M50 performs the above calculations with respect to each cylinder at intervals of a predetermined time.

As described above, the second air model A4 updates the estimated intake air amount KLfwd each time the predetermined time elapses. In this connection, it is to be noted that the second air model A4 calculates the estimated intake air amount KLfwd, based on the estimated throttle opening TAest to be established at a point in time later than the present time by the delay time that is substantially equal to the time period from a point (BTDC 90° CA) immediately before the start of the fuel injection to the time of the closing of the intake valve. It is also to be noted that the pre-correction estimated necessary fuel amount Fcfwdb is calculated based on the estimated intake air amount KLfwd obtained at the point immediately before the start of the fuel injection. Thus, the second air model A4 serves as an estimated intake air amount calculating unit that substantially estimates the intake air amount, based on the estimated throttle opening TAest to be established at the time of closing of the intake valve in the suction stroke of the cylinder.

Namely, the second intake air model A4 calculates the estimated intake air amount KLfwd as the amount of intake air present in the cylinder at the closing time A of the intake valve in the current or coming suction stroke A of a particular cylinder, at the first predetermined point in time, based on the operating state quantity obtained at a point in time later than the first predetermined point, which quantity is estimated by the electronically controlled throttle valve model M1 as an operating state quantity estimating unit, and the models M20 through M50. The first predetermined point is earlier than the closing time A of the intake valve in the current or coming suction stroke A of the cylinder. In this embodiment, the first predetermined point is a certain point in time (BTDC 90° CA) prior to the start of fuel injection (BTDC 75° CA) for the coming suction stroke of the cylinder. The above-indicated operating state quantity is the estimated throttle opening TAest to be established at a point in time in the vicinity of the intake-valve closing time A of the coming suction stroke A. In the manner as described above, the fuel injection amount fi is calculated by the models and units shown in FIG. 5 and FIG. 6.

As described above, the second intake air model A4 is different from the first intake air model A3 only in that the first intake air model A3 receives the actual throttle opening TAact whereas the second intake air model A4 receives the estimated throttle opening TAest. When the engine 1 is kept in a steady operating state for a predetermined period of time or longer, the estimated throttle opening TAest becomes equal to the actual throttle opening TAact (and the target throttle opening TAt), as is understood from the above expression (2) and FIG. 8 and FIG. 9. In this case, the estimated intake air amount KLfwd calculated by the second intake air model A4 becomes equal to the actual intake air amount KLact calculated by the first intake air model A3, and the pre-correction estimated necessary fuel amount Fcfwdb calculated based on the estimated intake air amount KLfwd and the target air/fuel ratio AbyFref becomes equal to the actual necessary fuel amount Fcact calculated based on the actual intake air amount KLact and the target air/fuel ratio AbyFref On the other hand, when the engine 1 is kept in a steady operating state for the predetermined period of time or longer, the normal estimated necessary fuel amount Fcfwd becomes equal to the fuel injection amount fi and the actual intake fuel amount Fcest, and the error Fcerr in the intake fuel amount, which is an input value of the PI controller, becomes equal to zero so that the actual necessary fuel amount Fcact becomes equal to the actual intake fuel amount Fcest. As a result, the pre-correction estimated necessary fuel amount Fcfwdb becomes equal to the normal estimated necessary fuel amount Fcfwd, and therefore the fuel feedback correction amount Ffb needs to be zero. In this case, therefore, an integral value SumFcerr of the error Fcerr in the intake fuel amount becomes equal to zero.

It will be understood from the above description that the integral value SumFcerr of the intake fuel amount error Fcerr as a difference between the actual necessary fuel amount Fcact and the actual intake fuel amount Fcest is sure to be made equal to zero each time the engine 10 is maintained in the steady operating state for the predetermined period of time or longer. In this connection, the integral value SumFcerr is equivalent to a time integral value of an excess or shortage of the fuel. Thus, each time the engine 10 returns to a steady operating state after shifting from a steady operating state to a transient operating state in which an excess or shortage of the fuel is likely to occur, it is assured that the time integral value of the excess or shortage of the fuel becomes equal to zero. Consequently, the average air/fuel ratio over a period in which the engine 10 shifts from a steady operating state to a transient operating state and then returns to a steady operating state again, namely, the ratio of the total intake air amount in this period to the total fuel (injection) amount in the same period, becomes equal to the target air/fuel ratio AbyFref.

Next, the actual operations of the electronic control unit 70 will be described with reference to the flowcharts shown in FIG. 11 through FIG. 18.

Calculation of Target Throttle Opening and Estimated Throttle Opening

Figure 11:
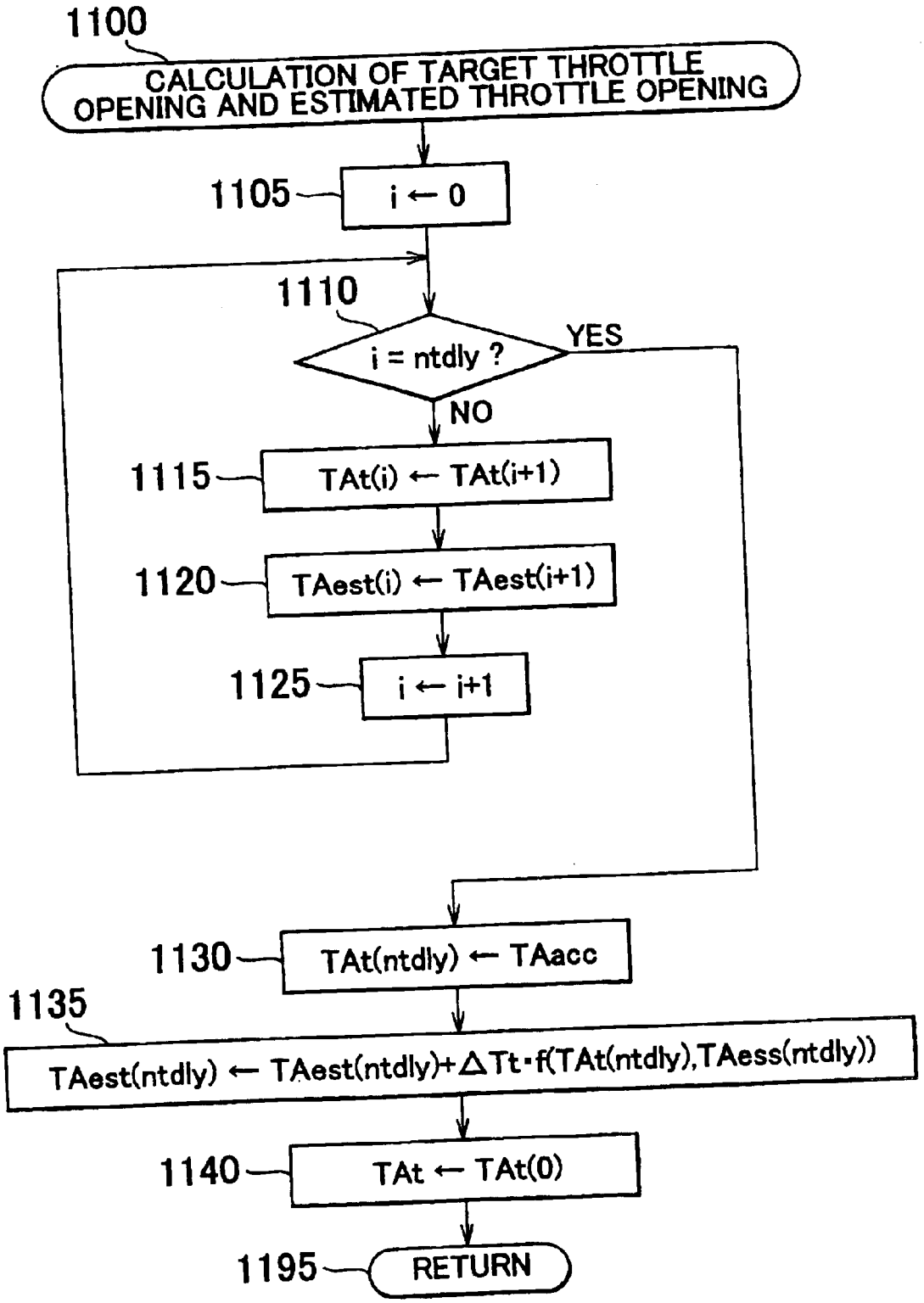
FIG. 11 is a flowchart showing a program executed by the CPU shown in FIG. 1 for calculating the target throttle opening and the estimated throttle opening.

The CPU 71 performs the functions of the electronically controlled throttle valve logic A1 and the electronically controlled throttle valve model M1 by executing a control routine shown in the flowchart of FIG. 11 upon each lapse of a computation period ΔTt (8 msec in this embodiment). More specifically, the CPU 71 starts the process from step S1100 in appropriate timing, and proceeds to step S1105 to set variable i to "0". The CPU 71 then proceeds to step S1110 to determine whether the variable i is equal to a delay count ntdly. The delay count ntdly is a value obtained by dividing the delay time TD by the computation period ΔTt.

Since the variable i is equal to "0" at this point in time, the CPU 71 makes a negative determination (NO) in step S110, and proceeds to step S115 to store the value of the provisional target throttle opening TAt(i+1) in the location of the provisional target throttle opening TAt(i). In the following step S1120, the CPU 71 stores the value of the estimated throttle opening TAest(i+1) in the location of the estimated throttle opening TAest(i). Through the above process, the value of the provisional target throttle opening TAt(1) is stored in the location of the provisional target throttle opening TAt(0), and the value of the estimated throttle opening TAest(1) is stored in the location of the estimated throttle opening TAest(0).

Subsequently, the CPU 71 increments the value of the variable i by "1" in step S1125, and returns to step S1110. If the current value of the variable i is smaller than the delay count ntdly, step S1115 through step S1125 are executed again. Namely, steps S1115–S1125 are repeatedly executed until the value of the variable i becomes equal to the delay count ntdly. With these steps thus repeated, the value of the provisional target throttle opening TAt(i+1) is sequentially shifted to the provisional target throttle opening TAt(i), and the value of the estimated throttle opening TAest(i+1) is sequentially shifted to the estimated throttle opening TAest (i).

If the value of the variable i becomes equal to the delay count ntdly after repeated execution of the above-described step S1125, the CPU 71 makes an affirmative determination (YES) in step S1110, and proceeds to step S1130. In step S1130, the CPU 71 determines the provisional target throttle opening TAacc for this cycle, based on the actual accelerator operation amount detected at the present time and the table as shown in FIG. 7. The provisional target throttle opening TAacc thus obtained is stored in the location of the provisional target throttle opening TAt(ntdly).

Subsequently, the CPU 71 proceeds to step S1135 to calculate the estimated throttle opening TAest(ntdly) for this cycle, based on the estimated throttle opening TAest(ntdly) obtained in the last cycle, the provisional target throttle opening TAacc obtained in this cycle, and the expression described in the block of step S1135, which is based on (the right side of) the above-indicated expression (2). In step S1140, the CPU 71 sets the value of the provisional target throttle opening TAt(0) to the target throttle opening TAt, while storing the latest estimated throttle opening TAest (ntdly) in the location of the estimated throttle opening TAest. The CPU 71 then proceeds to step S1195 to finish the current cycle of the present routine.

As described above, the content of a memory associated with the target throttle opening TAt is shifted one by one each time the present routine is executed, and the value stored in the provisional target throttle opening TAt(0) is set as the target throttle opening TAt to be generated from the electronically controlled throttle logic A1 to the throttle actuator 43*a*. Namely, the value stored in the provisional target throttle opening TAt(ntdly) during execution of this cycle of the routine will be stored in TAt(0) to provide the target throttle opening TAt when the present routine is repeated the number of times equal to the delay count ntdly. With regard to a memory associated with the estimated throttle opening TAest, the estimated throttle opening TAest to be established upon a lapse of a certain time (m*ΔTt) from the present time is stored in the location of TAest(m) in the memory. In this case, the value m takes an integer that ranges from 1 to ntdly.

Calculation of Estimated Intake Air Amount KLfwd

Figure 12:
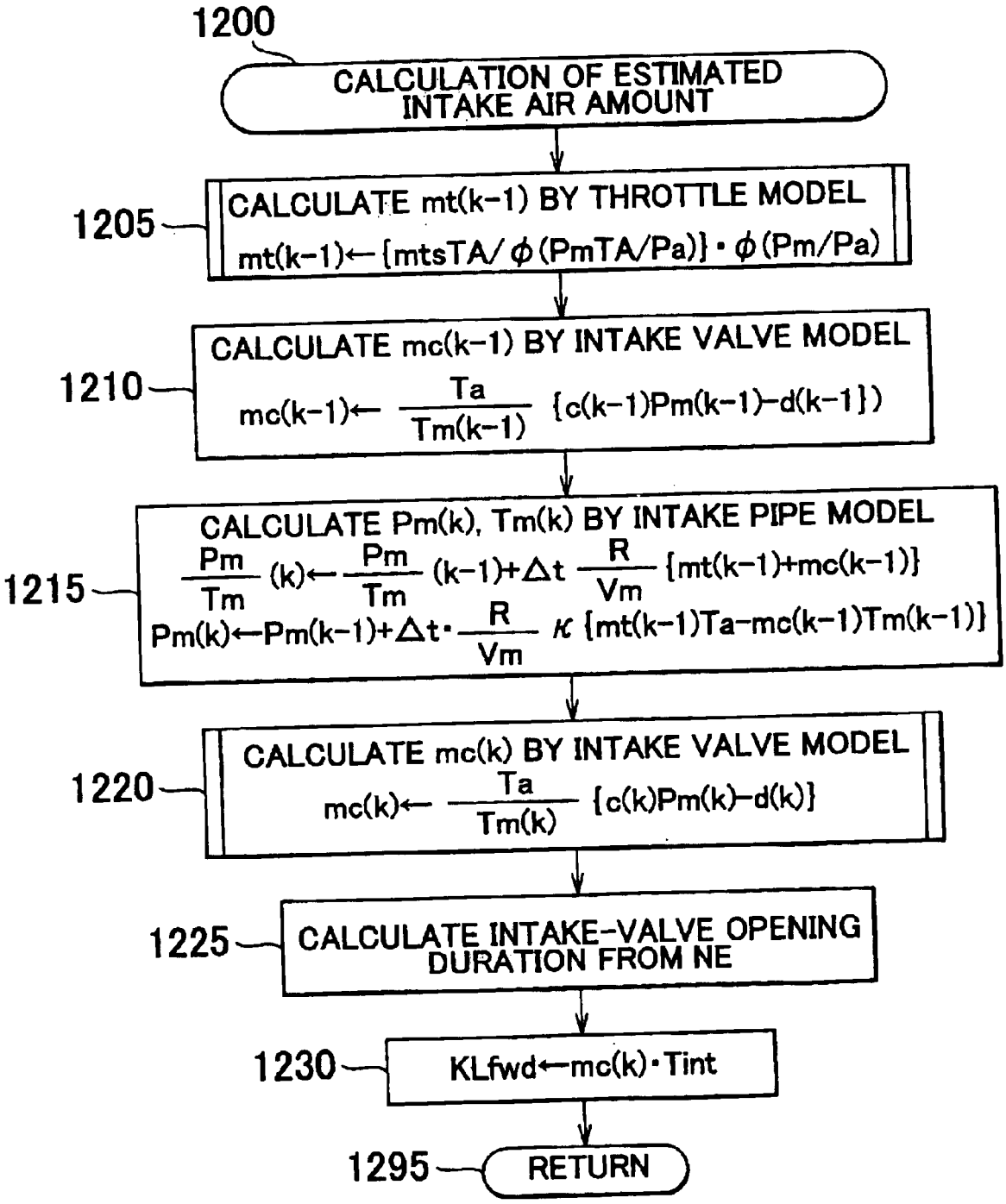
FIG. 12 is a flowchart showing a program executed by the CPU of FIG. 1 for calculating an estimated intake air amount.

The CPU 71 performs the functions of the second intake air model A4 (the throttle model M20, intake valve model M30, intake pipe model M40 and the intake valve model M50) by executing an estimated intake air amount calculating routine as shown in FIG. 12 upon each lapse of the predetermined computation period ΔTt (8 msec). More specifically, the CPU 71 starts the process from step S1200 in appropriate timing, and proceeds to step S1205 to calculate the throttle passing air flow rate mt(k−1) according to the throttle model M20 (the expression indicated in the block of step S1205 and based on the above expression (29)). To perform this calculation, the CPU 71 proceeds to step S1300 shown in the flowchart of FIG. 13. The reason why the variable in the parentheses of the throttle passing air flow rate mt is k−1, rather than k, is that the throttle passing air flow rate mt(k−1) is calculated by using various values obtained earlier than the present time by the computation period ΔTt. In the following description, variables "k" and "k−1" accompanying other values as described below are to be interpreted in the same way.

Figure 13:
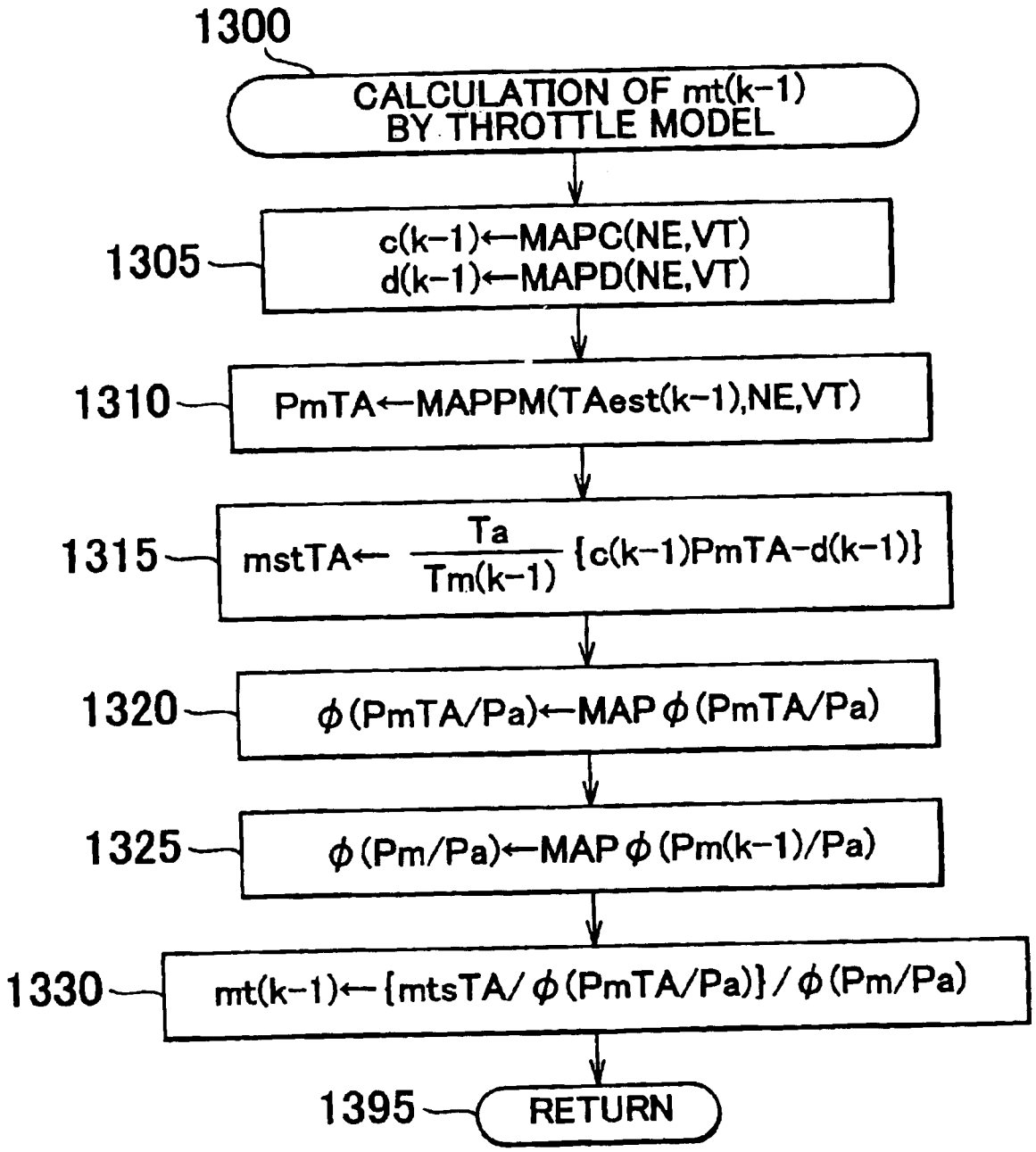
FIG. 13 is a flowchart showing a program executed by the CPU of FIG. 1 for calculating an estimated throttle passing air flow rate.

Referring to FIG. 13, the CPU 71 proceeds to step S1305 to determine coefficient c (=c(k−1)) of the above expression (30) from the above-mentioned table MAPC, the engine speed NE detected the computation period ΔTt earlier than the present time, and the intake valve opening/closing timing VT detected the computation period ΔTt earlier than the present time. Similarly, the CPU 71 determines coefficient d (=d(k−1)) from the above-mentioned table MAPD, the engine speed NE detected the computation period ΔTt earlier than the present time, and the intake valve opening/closing timing VT detected the computation period ΔTt earlier than the present time.

Subsequently, the CPU 71 proceeds to step S1310 to calculate a period of time from a point (BTDC 90° CA) immediately before the start of the fuel injection to the intake-valve closing time, and reads from the RAM 73 the estimated throttle opening TAest for a point in time later than the present time by a delay time substantially equal to the calculated time period, to set the read value to the estimated throttle opening TAest(k−1). The CPU 71 then determines the intake pipe pressure PmTA from the estimated throttle opening TAest(k−1), the engine speed NE detected the computation period ΔTt earlier than the present time, the intake valve opening/closing timing VT detected the computation period ΔTt earlier than the present time, and the above-mentioned table MAPPM. The CPU 71 then proceeds to step S1315 to calculate the throttle passing air flow rate mtsTA based on the above expression (30). Here, the intake air temperature THA detected by the intake air temperature sensor is used as the throttle passing air temperature Ta in step S1315, and a value obtained in step S1215 as described later during execution of the last cycle of the present routine is used as the air temperature Tm(k−1) in the intake pipe.

Subsequently, the CPU 71 proceeds to step S1320 to determine Φ(PmTA/Pa) from the above-mentioned table MAPΦ and a value (PmTA/Pa) obtained by dividing the intake pipe pressure PmTA obtained in step S1310 by the throttle valve upstream pressure (i.e., the atmospheric pressure detected by the atmospheric pressure sensor 63) Pa. In the following step S1325, the CPU 71 determines Φ(Pm/Pa) from a value (Pm(k−1)/Pa) obtained by dividing the intake pipe pressure Pm(k−1) obtained in step S1215 as described later during execution of the last cycle of the present routine by the throttle valve upstream pressure Pa, and the above-mentioned table MAPΦ. In the following step S1330, the CPU calculates the throttle passing air flow rate mt(k−1), based on the values obtained in steps S1315, S1320 and S1325 and the expression indicated in the block of step S1330, which represents the throttle model. The CPU 71 then proceeds to step S1210 of FIG. 12 via step S1395.

In step S1210, the CPU 71 calculates the in-cylinder intake air flow rate mc(k−1) by using the above-indicated expression (30) that represents the intake valve model M3. In this step, the values obtained in the above step S1305 are used as the coefficient c and the value d. Also, the value obtained in step S1215 as described later during execution of the last cycle of the present routine is used as the intake pipe air temperature Tm(k−1), and the intake air temperature THA detected by the intake air temperature sensor is used as the throttle passing air temperature Ta.

Next, the CPU 71 proceeds to step S1215 to calculate the intake pipe pressure Pm(k) for this cycle and a value {Pm/Tm}(k) by dividing the intake pipe pressure Pm(k) by the intake pipe air temperature Tm(k) for this cycle, based on expressions (difference equations) indicated in the block of step S1215, which are derived from the above expressions (31) and (32) representing the intake pipe model M4, and the throttle passing air flow rate mt(k−1) and in-cylinder intake air flow rate mc(k−1) obtained in step S1205 and step S1210, respectively. In the expressions in step S1215, Δt represents a discrete interval used by the intake pipe model M40. Namely, Δt is expressed as $\Delta t=\Delta Tt+(t_1-t_0)$ where ΔTt is the computation period (=8 msec), to is a period of time (calculated in the last cycle (k−1)) from the start of the fuel injection to the intake-valve closing time, and $t_1$ is a period of time (calculated in the current cycle (k)) from the start of the fuel injection to the intake-valve closing time.

Subsequently, the CPU 71 proceeds to step S1220 to calculate the in-cylinder intake air flow rate mc(k) for this cycle, based on the expression indicated in step S1220, which represents the intake valve model M50. More specifically, in step S1220, the CPU 71 proceeds to step S1440 shown in FIG. 14 to determine coefficient c(k) (=MAPC(NE, VT) from the engine speed NE, the intake valve opening/closing timing VT and MAPC in step S1405, and then proceeds to step S1410 to determine value d(k) (=MAPD(NE, VT)) from the engine speed NE, the intake valve opening/closing timing VT and MAPD. In these steps, the current values detected at the present time are used as the engine speed NE and the intake valve opening/closing timing VT. The CPU 71 then proceeds to step S1415 to calculate the in-cylinder intake air flow rate mc(k) by using the intake pipe pressure Pm(k) obtained in step S1215 in this cycle, the intake pipe air temperature Tm(k) obtained in step S1215 in this cycle, the coefficient c(k) obtained in step S1405 and the value d(k) obtained in step S1410. The CPU 71 then proceeds to step S1225 of FIG. 12 via step S1495.

In step S1225, the CPU 71 calculates an intake-valve opening duration Tint (i.e., the time period from opening of the intake valve to closing thereof), based on the current engine speed NE, and an opening angle of the intake valve that is determined by a cam profile of the intake camshaft. In the following step S1230, the CPU 71 calculates the estimated intake air amount KLfwd by multiplying the in-cylinder intake air flow rate mc(k) obtained in this cycle by the intake-valve opening duration Tint, and proceeds to step S1295 to finish the current cycle of the present routine. In this manner, the estimated intake air amount KLfwd is determined.

Actual Intake Air Amount KLact

Figure 14:
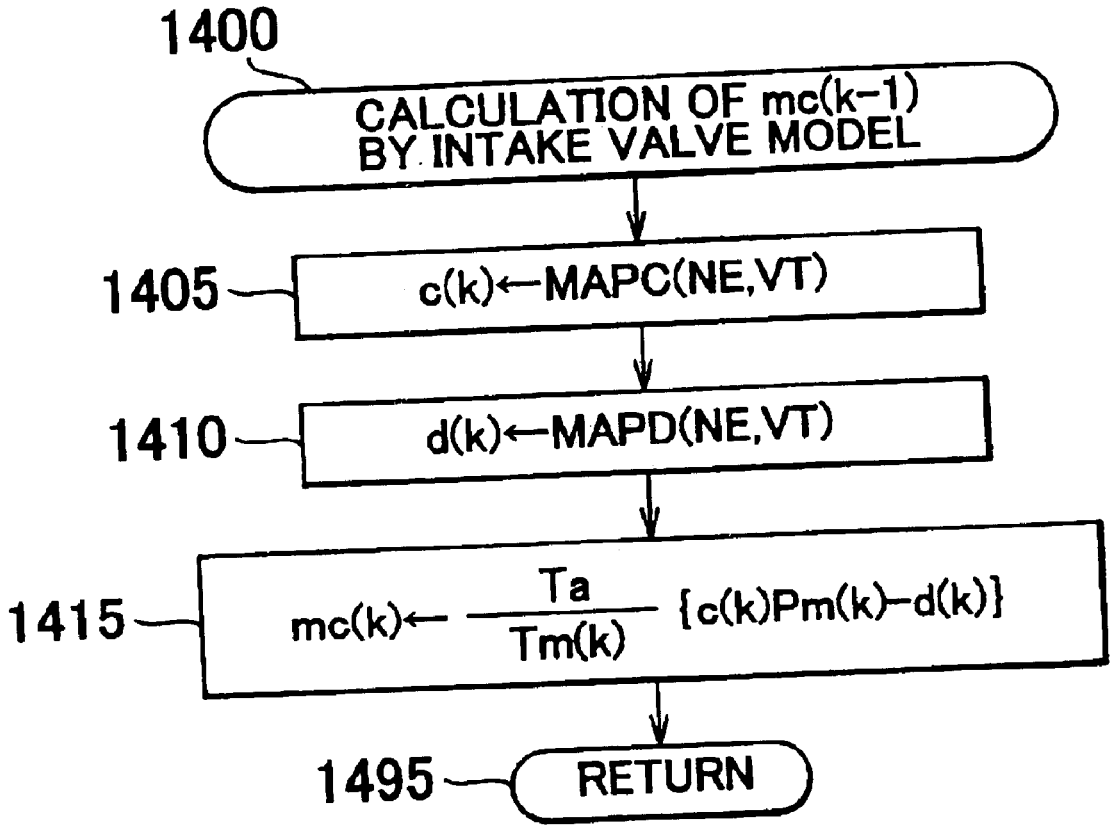
FIG. 14 is a flowchart showing a program executed by the CPU of FIG. 1 for calculating an estimated intake air flow rate.
Figure 15:
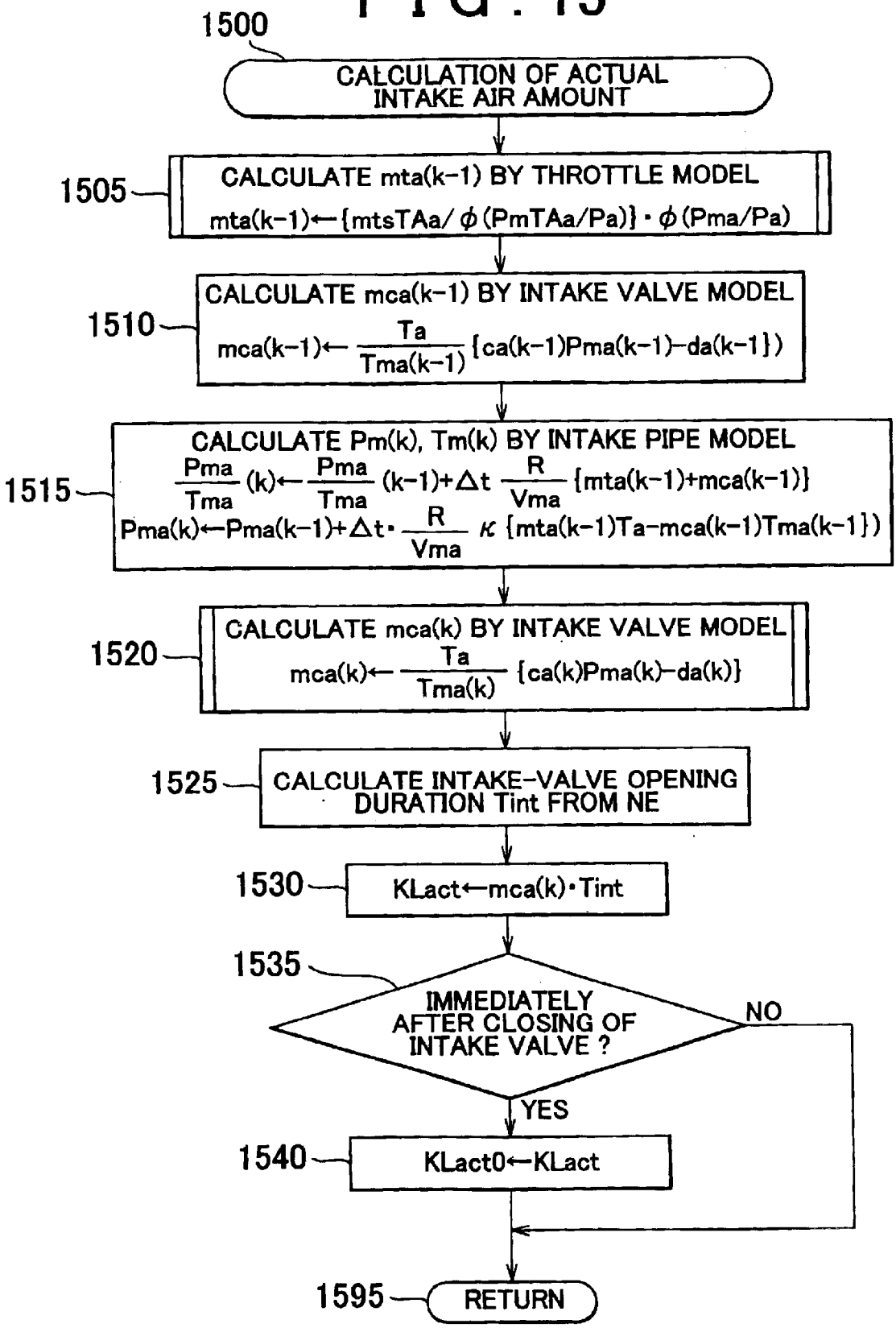
FIG. 15 is a flowchart showing a program executed by the CPU of FIG. 1 for calculating an actual intake air amount.

The CPU 71 performs the functions of the first intake air model A3 (the throttle model M2, intake valve model M3, intake pipe model M4, and the intake valve model M5) by executing an actual intake air amount calculating routine as shown in FIG. 15 upon each lapse of the predetermined computation period ΔTt (8 msec). This routine calculates the actual intake air amount KLact through a process similar to that of the estimated intake air amount calculating routine of FIG. 12 as described above. To this end, the CPU 71 executes routines shown in FIG. 16 and FIG. 17 for performing similar operations to those of the routines shown in FIG. 13 and FIG. 14. In order to distinguish various amounts or values, such as the throttle passing air flow rate, used in the routines of FIG. 15–FIG. 17 from those used in the routines of FIG. 12–FIG. 14, letter "a" is added to the end of the symbol denoting each amount or value.

Figure 16:
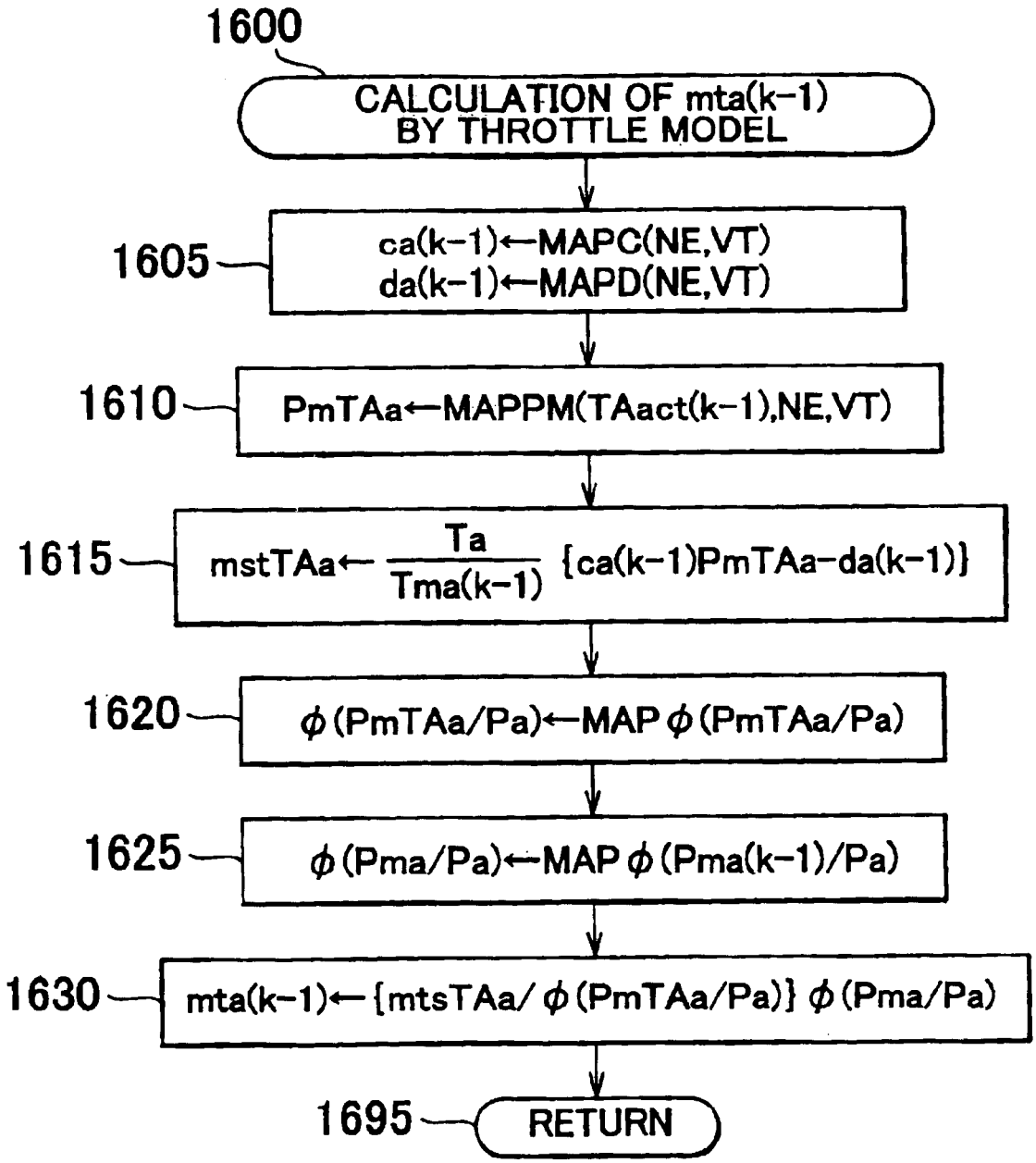
FIG. 16 is a flowchart showing a program executed by the CPU of FIG. 1 for calculating an actual throttle passing air flow rate.
Figure 17:
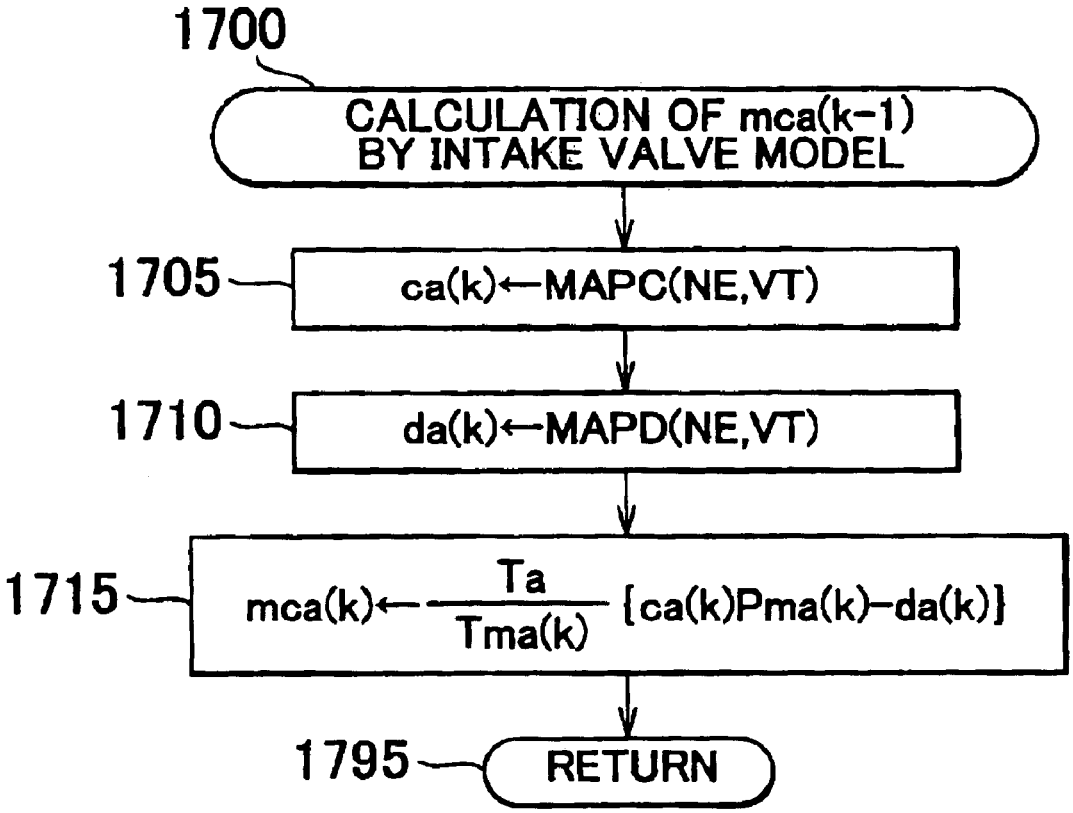
FIG. 17 is a flowchart showing a program executed by the CPU of FIG. 1 for calculating an actual intake air flow rate.

Differences between the routines shown in FIG. 15–FIG. 17 and the routines shown in FIG. 12–FIG. 14 will be briefly described. In step S1505 of FIG. 15, the CPU 71 calculates the throttle passing air flow rate mta (k−1) according to the throttle model M2 (the expression indicated in step S1505 and based on the above expression (29)).

In step S1505, the CPU 71 executes the routine as shown in FIG. 16. Initially, the CPU 71 determines coefficient c (=ca(k−1)) of the above expression (30) in step S1605, from the above-mentioned table MAPC, the engine speed NE detected the computation period ΔTt earlier than the present time, and the intake valve opening/closing timing VT detected the computation period ΔTt earlier than the present time. Similarly, the CPU 71 determines value d (=da(k−1)) from the above-mentioned table MAPD, the engine speed NE detected the computation period ΔTt earlier than the present time, and the intake valve opening/closing timing VT detected the computation period ΔTt earlier than the present time.

Subsequently, the CPU 71 proceeds to step S1610 to determine the intake pipe pressure PmTAa from the above-mentioned table MAPPM, the actual throttle opening TAact (k−1) detected the computation period ΔTt earlier than the present time, the engine speed NE detected the computation period ΔTt earlier than the present time, and the intake valve opening/closing timing VT detected the computation period ΔTt earlier than the present time. The CPU 71 then proceeds to step S1615 to calculate the throttle passing air flow rate mtsTAa based on the above-indicated expression (30). Here, the intake air temperature THA detected by the intake air temperature sensor is used as the throttle passing air temperature Ta used in step S1615, and a value obtained in step S1515 as described later during the last cycle of the present routine is used as the intake pipe air temperature Tma(k−1).

Subsequently, the CPU 71 proceeds to step S1620 to determine value Φ(PmTAa/Pa) from a value (PmTAa/Pa) obtained by dividing the intake pipe pressure PmTAa by the throttle valve upstream pressure Pa, and the above-mentioned MAPΦ. In the following step S1625, the CPU 71 determines value Φ(Pma/Pa) from a value (Pma(k−1)/Pa) obtained by dividing the intake pipe pressure Pma(k−1) obtained in step S1515 as described later during the last cycle of the present routine by the throttle valve upstream pressure Pa, and the above-mentioned table MAPΦ. In the following step S1630, the CPU 71 calculates the throttle passing air flow rate mta(k−1) based on the values obtained in steps S1615, S1620 and S1625, respectively, and an expression indicated in the block of step S1630, which represents the throttle model. The CPU 71 then proceeds to step S1510 of FIG. 15 via step S1695.

In step S1510, the CPU 71 calculates the in-cylinder intake air flow rate mca(k−1) by using the expression (30) that represents the intake valve model M30. In this step, the values obtained in the above step S1605 are used as the coefficient ca and the value da. Also, the values obtained in step S1515 as described later during execution of the last cycle of the present routine are used as the intake pipe pressure Pma(k−1) and the intake pipe air temperature Tma(k−1), and the intake air temperature THA detected by the intake air temperature sensor is used as the throttle passing air temperature Ta.

After execution of step S1510, the CPU 71 proceeds to step S1515 to calculates the intake pipe pressure Pma (k) for this cycle, and a value {Pma/Tma}(k) obtained by dividing the intake pipe pressure Pma(k) by the intake pipe air temperature Tma(k) for this cycle, based on the throttle passing air flow rate mta(k−1) and the in-cylinder intake air flow rate mca(k−1). The CPU 71 then proceeds to step S1520 to calculate the in-cylinder intake air flow rate mca(k) for this cycle, based on an expression indicated in the block of step S1520, which represents the intake valve model M50. In this case, the CPU 71 determines coefficient ca(k) (=MAPC (NE, VT)) in step S1705 shown in FIG. 17, from the engine speed NE, the intake valve opening/closing timing VT and MAPC, and determines value da(k) (=MAPD (NE, VT)) in step S1710 from the engine speed NE, the intake valve opening/closing timing VT and MAPD. The engine speed NE and the intake valve opening/closing timing VT used in these steps are values detected at the present time. The CPU 71 then proceeds to step S1715 to calculate the in-cylinder intake air flow rate mca(k) for this cycle, by using the intake pipe pressure Pma(k) of this cycle, the intake pipe air temperature Tma(k) of this cycle, the coefficient ca(k) and the value da(k). The CPU 71 then proceeds to step S1525 of FIG. 15 via step S1795.

In step S1525, the CPU 71 calculates an intake-valve opening duration Tint, based on the current engine speed NE, and an opening angle of the intake valve that is determined by the cam profile of the intake camshaft. In the following step S1530, the CPU 71 calculates the actual intake air amount KLact by multiplying the in-cylinder intake air flow rate mca(k) obtained in this cycle by the intake-valve opening duration Tint. The CPU 71 then proceeds to step S1535 to determine whether the present time is immediately after shifting or transition of the intake valve from the open state to the closed state. If it is immediately after closing of the intake valve, the CPU 71 stores the actual intake air amount KLact in the location of the actual intake air amount KLact0 at the time of closing of the intake valve in step S1540, and proceeds to step S1595 to finish the current cycle of the routine. If a negative determination is made in step S1535, the CPU 71 directly proceeds to step S1595 to finish the current cycle of the routine. In this manner, the actual intake air amount KLact0 as the actual amount of intake air present in the cylinder at the time of closing of the intake valve is obtained based on the actual throttle opening TAact. The actual intake air amount KLact0 is determined with respect to each cylinder, and is stored in the RAM 73 while being associated with each cylinder.

Injection Execution Routine

Figure 18:
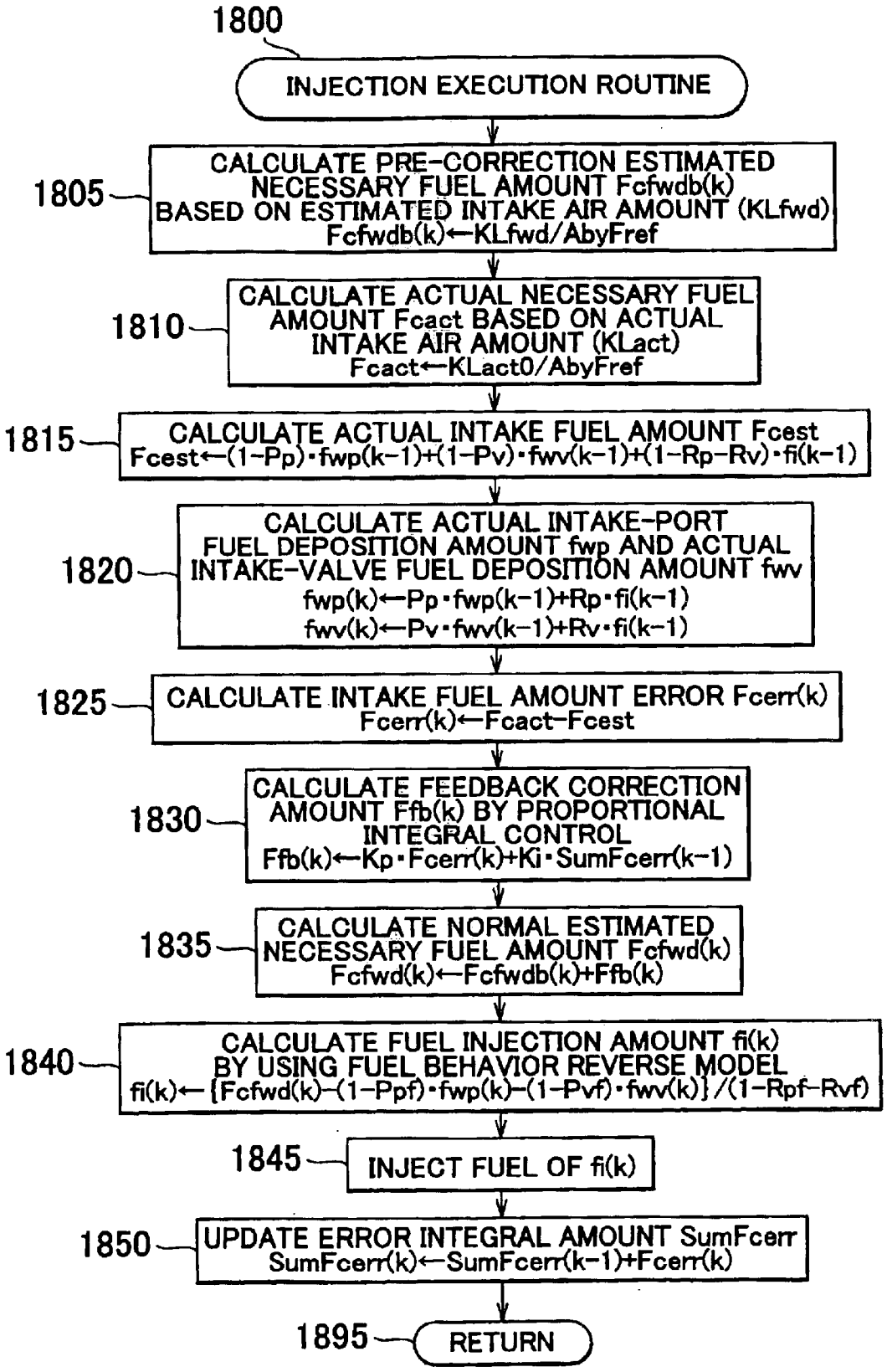
FIG. 18 is a flowchart showing a program executed by the CPU of FIG. 1 for executing fuel injection (i.e., calculating the fuel injection amount).

Next, a routine executed by the electronic control unit 70 for performing the actual fuel injection will be described with reference to the flowchart of FIG. 18 showing this routine. The CPU 71 executes the routine shown in FIG. 18 with respect to each cylinder, each time the crank angle of each cylinder becomes equal to BTDC 90° CA.

When the crank angle of a particular cylinder becomes equal to BTDC 90° CA, the CPU 71 starts the process from step S1800, and calculates the pre-correction estimated necessary fuel amount Fcfwdb(k) by dividing the estimated intake air amount KLfwd by the target air/fuel ratio AbyFref (i.e., Fcfwdb=KLfwd/AbyFref) in step S1805.

The CPU 71 then proceeds to step S1810 to read, from the RAM 73, the actual intake air amount KLact0 at the time of closing of the intake valve in the previous suction stroke of the particular cylinder. In this step, the CPU 71 calculates the actual necessary fuel amount Fcact required for achieving the target air/fuel ratio AbyFref in the previous suction stroke of the particular cylinder, by dividing the actual intake air amount KLact0 by the target air/fuel ratio AbyFref obtained by the target air/fuel ratio setting means A5 (KLact0/AbyFref).

Subsequently, the CPU 71 proceeds to step S1815 to calculate the actual intake fuel amount Fcest. More specifically, the CPU 71 initially calculates the intake-port fuel deposition rate Rp, intake-valve fuel deposition rate Rv, intake-port fuel remaining rate Pp and the intake-valve fuel remaining rate Pv, based on the actual throttle opening TAact detected at the time of closing of the intake valve in the previous suction stroke of the particular cylinder, the actual engine speed NE detected at the closing time of the intake valve in the same stroke, and the actual opening/closing timing of the intake valve 32 detected at the closing time of the intake valve in the same stroke. Then, the CPU 71 calculates the actual intake fuel amount Fcest as the actual amount of fuel inducted into the cylinder in the previous suction stroke of the cylinder, based on the fuel injection amount fi(k−1) actually injected for the previous suction stroke, the actual amount fwp(k−1) of fuel deposited in the intake port, the actual amount fwv(k−1) of fuel deposited on the intake valve, and the expression described in step S1815, which corresponds to the right side of the above-indicated expression (5). The actual fuel deposition amounts fwp(k−1) and fwv(k−1) are those of fuel deposited after the second previous suction stroke of the cylinder and before the previous suction stroke.

The CPU 71 then proceeds to step S1820 to calculate the actual intake-port fuel deposition amount fwp(k) and the actual fuel intake-valve fuel deposition amount fwv(k), which are the amounts of fuel deposited after the previous suction stroke and before the coming suction stroke, according to the expressions described in step S1820, which correspond to the above expressions (3) and (4), respectively. These calculations are performed based on the fuel injection amount fi(k−1), the actual intake-port fuel deposition amount fwp(k−1), and the actual intake-valve fuel deposition amount fwv(k−1), the intake-port fuel deposition rate Rp, the intake-valve fuel deposition rate Rv, the intake-port fuel remaining rate Pp, and the intake-valve fuel remaining rate Pv, all of which are used in step S1815.

Subsequently, the CPU 71 proceeds to step S1825 to calculate an intake fuel amount error Fcerr(k) that represents an excess or shortage of the fuel amount in the previous suction stroke, by subtracting the actual intake fuel amount Fcest calculated in step S1815 from the actual necessary fuel amount Fcact calculated in step S1810 with respect to the previous suction stroke, according to the above-indicated expression (6). In the following step S1830, the CPU 71 calculates the fuel feedback correction amount Ffb(k) according to the expression described in step S1830 and based on the above-indicated expression (7). In the expression described in step S1830, SumFcerr is an integral value of the intake fuel amount error Fcerr calculated according to the above expression (8), and will be calculated in step S1850 as described later. In the same expression, coefficients Kp and Ki are a preset proportional constant and a preset integration constant, respectively. Thus, step S1850 provides a part of the feedback controller (PI controller) for calculating the fuel feedback correction amount Ffb.

The CPU 71 then proceeds to step S1835 to calculate the normal estimated necessary fuel amount Fcfwd(k) for the coming suction stroke, by correcting the pre-correction estimated necessary fuel amount Fcfwdb(k) obtained in step S1805 with the fuel feedback correction amount Ffb(k) obtained in step S1830, namely, by adding the fuel feedback correction amount Ffb(k) to the pre-correction estimated necessary fuel amount Fcfwd(k).

Subsequently, the CPU 71 proceeds to step S1840 to calculate the fuel injection amount fi(k). More specifically, the CPU 71 initially calculates the intake-port fuel deposition rate Rpf, intake-valve fuel deposition rate Rvf, intake-port fuel remaining rate Ppf, and the intake-valve fuel remaining rate Pvf, based on the estimated throttle opening TAest to be established at the closing time of the intake valve in the coming suction stroke of the particular cylinder, the actual engine speed NE, and the actual intake valve opening/closing timing VT. The CPU 71 then calculates the fuel injection amount fi(k) based on the actual intake-port fuel deposition amount fwp(k) and the actual intake-valve fuel deposition amount fwv(k) calculated in step S1820, and the fuel behavior reverse model represented by the right side of the above expression (11) (the expression described in the block of step S1840). The actual fuel deposition amounts fwp(k) and fwv(k) are the amounts of fuel deposited after the previous suction stroke of the particular cylinder and before the coming suction stroke.

The CPU 71 then proceeds to step S1845 to generate a command to inject a fuel of the fuel injection amount fi(k), to the injector 39 of the particular cylinder. As a result, the fuel is injected in an amount corresponding to the fuel injection amount fi(k), from the injector 39 of the particular cylinder. Subsequently, the CPU 71 proceeds to step S1850 to update the error integral value SumFcerr by integrating the intake fuel amount error Fcerr, for use in calculation in the next cycle of the present routine, and, finishes the current cycle of the routine in step S1895.

In the illustrated embodiment of the fuel injection amount control apparatus of the internal combustion engine according to the invention, the actual necessary fuel amount and the actual intake fuel amount for the previous suction stroke are calculated, and an excess or shortage of the fuel amount in the previous suction stroke is calculated based on a difference between these amounts. Then, the excess or shortage of the fuel amount is reflected by the estimated necessary fuel amount for the coming and subsequent suction strokes, to be thus compensated for or eliminated. It is thus possible to immediately compensate for an excess or shortage of the supplied fuel amount due to a difference between the estimated operating state quantity (estimated throttle opening, or estimated intake air amount) obtained by the operating state quantity estimating unit and the actual throttle opening (or the actual intake air amount), so that the air/fuel ratio can be kept substantially constant.

In the illustrated embodiment, the fuel injection amount is calculated based on the normal estimated necessary fuel amount resulting from correction using the fuel feedback correction amount. Accordingly, the fuel of the normal estimated necessary fuel amount that surely reflects the fuel feedback correction amount can be precisely introduced into the fuel injection cylinder, irrespective of the operating conditions of the engine. This arrangement eliminates a need to change feedback control constants, such as a proportional gain, used by the feedback controller (PI controller) for calculating the fuel feedback correction amount, depending upon frequently changing operating conditions of the engine, thus permitting simple construction of the feedback controller.

In the illustrated embodiment, the estimated intake air amount becomes equal to the actual intake air amount when the engine is in a steady operating state. Accordingly, it is guaranteed that the time integral value of the intake fuel amount error used by the PI controller becomes equal to zero each time the engine is maintained in a steady operating state for a predetermined time or longer. Since the time integral value of the intake fuel amount corresponds to a time integral value of an excess or shortage of the fuel, it is guaranteed that the time integral value of the excess or shortage of the fuel becomes equal to zero each time the engine returns to a steady operating state after once shifting from a steady operating state to a transient operating state in which an excess or shortage of the fuel is likely to occur. Consequently, the average air/fuel ratio in a period in which the engine once shifts from a steady operating state to a transient operating state and then returns to a steady operating state again can be made equal to the target air/fuel ratio. Accordingly, the amount of oxygen stored in the three-way catalyst can be kept at an appropriate amount. Consequently, the oxygen storage/release functions of the three-way catalyst do not deteriorate, and an otherwise possible increase in the amount of emissions of exhaust gas can be avoided or suppressed.

It is to be understood that the invention is not limited to details of the illustrated embodiment, but various modified examples may be employed within the scope of the invention. For example, when the engine is in a steady operating state, the intake air amount for the current or coming suction stroke is preferably determined substantially based on the output of the air flow meter 61.

Figure 6:
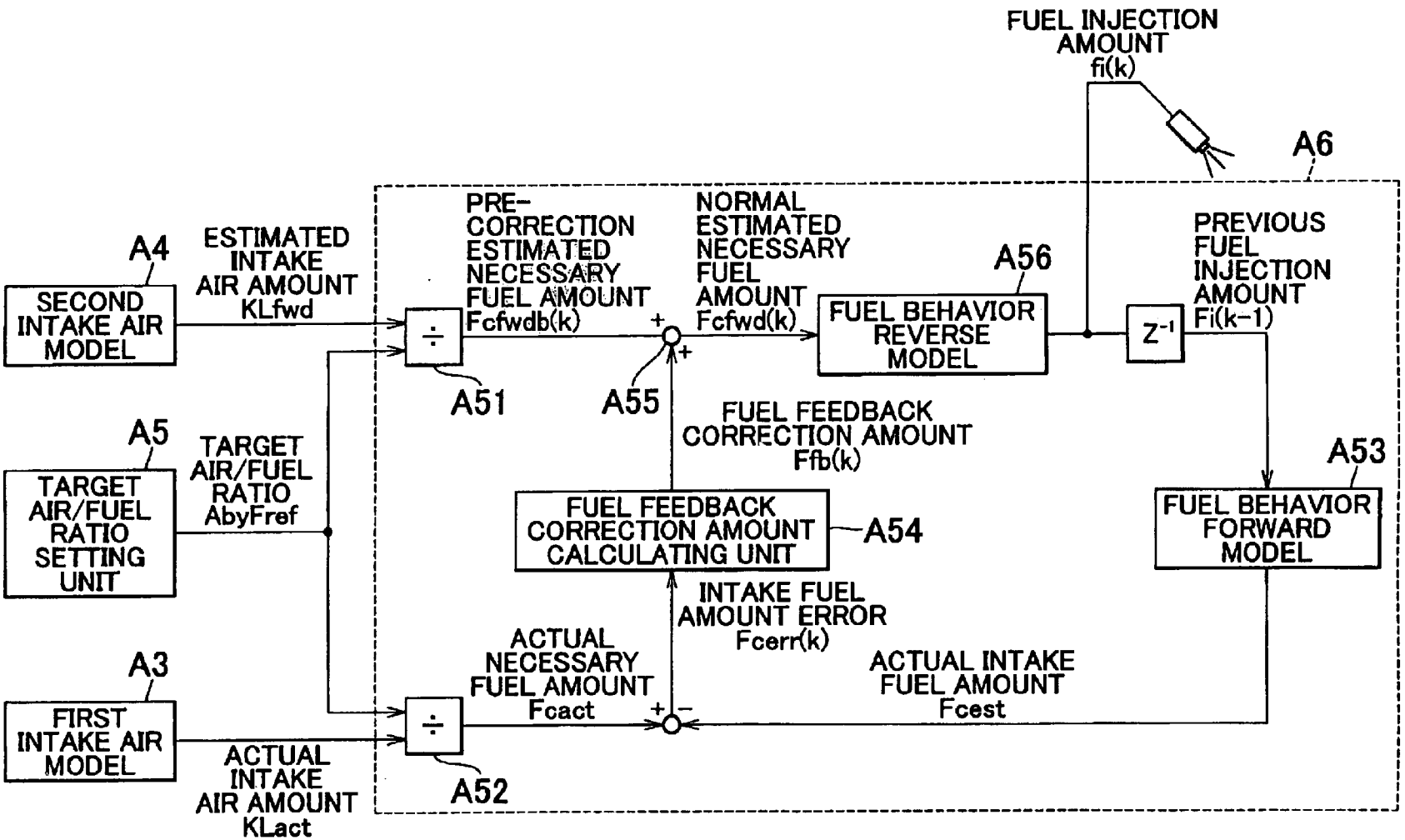
FIG. 6 is a function block diagram showing details of an injection amount determining unit shown in FIG. 5.

In the illustrated embodiment, the fuel injection amount is calculated by the models and units shown in FIG. 5 and FIG. 6 for each cylinder (a particular cylinder) of the engine, with respect to each suction stroke of the cylinder. However, the fuel injection amount control apparatus of the invention may be arranged to calculate the fuel injection amount by the models and units shown in FIG. 5 and FIG. 6 for each suction stroke of the engine, with respect to non-particular cylinders that successively enter suction strokes, without discriminating one cylinder from another.

In the illustrated embodiment, the fuel injection amount calculating unit (the reverse model of the fuel behavior model) calculates the fuel deposition amount, based on the actual amount of fuel deposited after the previous suction stroke and before the current or coming suction stroke, which is calculated by the actual fuel deposition amount calculating unit (the forward model of the fuel behavior model). However, the fuel injection amount calculating unit may include an estimated fuel deposition amount calculating unit, apart from the actual fuel deposition amount calculating unit, and may be arranged to calculate the fuel deposition amount based on an estimated fuel deposition amount as an amount of fuel deposited after the previous suction stroke and before the current or coming suction stroke, which is calculated by the estimated fuel deposition amount calculating unit.

Namely, the fuel injection amount calculating unit may be arranged to calculate the fuel injection amount so that the sum of the amount of fuel drawn into the cylinder during the coming suction stroke, out of the amount of fuel to be injected for the coming suction stroke, and the amount of fuel drawn into the cylinder during the coming suction stroke, out of the estimated fuel deposition amount, becomes equal to the calculated normal estimated necessary fuel amount. As described above, the estimated fuel deposition amount calculated by the estimated fuel deposition amount calculating unit is the amount of fuel deposited after the previous suction stroke and before the coming suction stroke. In this case, the estimated fuel deposition amount calculating unit may be arranged to determine the deposition rate and the remaining rate used by the fuel behavior model, based on the estimated intake air amount for the previous suction stroke (namely, the intake air amount calculated by the estimated intake air amount calculating unit at a point in time prior to closing of the intake valve in the previous suction stroke, as the amount of intake air that would be present in the cylinder at the time of closing of the intake valve). Then, the estimated fuel deposition amount calculating unit may calculate the estimated fuel deposition amount as the amount of fuel deposited after the previous suction stroke and before the coming suction stroke, based on the fuel behavior model using the thus determined deposition rate and remaining rate, the estimated fuel deposition amount as the amount of fuel deposited after the second previous suction stroke and before the previous suction stroke, and the actual fuel injection amount for the previous suction stroke.

What is claimed is:

1. A method of controlling a fuel injection amount of an internal combustion engine with respect to a suction stroke for which fuel is injected, comprising the steps of:

estimating an operating state quantity of the engine to be established at the time of closing of an intake valve in the suction stroke in question, at a point in time prior to the time of closing of the intake valve;

estimating an intake air amount in the suction stroke based on the estimated operating state quantity;

calculating, as a pre-correction estimated necessary fuel amount, a provisional fuel amount that is needed along with the estimated intake air amount to achieve a target air/fuel ratio;

calculating an actual necessary fuel amount as an amount of fuel actually needed for achieving the target air/fuel ratio in a previous suction stroke that precedes the suction stroke in question, based on a known value of the operating state quantity, at a point in time after closing of the intake valve in the previous suction stroke;

calculating an actual intake fuel amount as an amount of fuel actually inducted into a cylinder of the engine during the previous suction stroke, based on at least an amount of fuel actually injected for the previous suction stroke;

determining an excess or shortage of the fuel in the previous suction stroke based on the calculated actual necessary fuel amount and the calculated actual intake fuel amount, and calculating a fuel feedback correction amount corresponding to the determined excess or shortage of the fuel;

calculating a normal estimated necessary fuel amount by correcting the pre-correction estimated necessary fuel amount with the calculated fuel feedback correction amount;

calculating a fuel injection amount based on at least the calculated normal estimated necessary fuel amount; and injecting the fuel having the calculated fuel injection amount for the suction stroke in question, at a point in time before the time of closing of the intake valve in the suction stroke.

2. An apparatus for controlling a fuel injection amount of an internal combustion engine including a fuel injector that injects a fuel in response to a command, with respect to a suction stroke for which the fuel is injected, comprising:

an operating state quantity estimating unit that estimates an operating state quantity of the engine to be established at a point in time that is later than the present time;

an operating state quantity acquiring unit that acquires an actual operating state quantity of the engine established at a point in time that is earlier than the present time;

an estimated intake air amount calculating unit that calculates an estimated intake air amount as an amount of intake air that will be present in a cylinder of the engine at the time of closing of an intake valve in the suction stroke in question, at a first predetermined point in time that is earlier than the time of closing of the intake valve in the suction stroke, the estimating intake air amount being calculated based on the operating state quantity to be established at a point in time later than the first predetermined point, which quantity is estimated by the operating state quantity estimating unit, and an air model that models the behavior of air in an intake system of the engine;

a pre-correction estimated necessary fuel amount calculating unit that calculates a pre-correction estimated necessary fuel amount as a provisional amount of fuel needed in the suction stroke in question, based on the estimated intake air amount, at a second predetermined point in time that is later than the first predetermined point and is earlier than the time of closing of the intake valve in the suction stroke;

an actual intake air amount calculating unit that calculates an actual intake air amount as an amount of intake air that was actually present in the cylinder at the time of closing of the intake valve in a previous suction stroke that precedes the suction stroke in question, at a third predetermined point in time that is later than the time of closing of the intake valve in the previous suction stroke and is earlier than the time of closing of the intake valve in the suction stroke in question, the actual intake air amount being calculated based on the actual operating state quantity acquired by the operating state quantity acquiring unit and the air model;

an actual necessary fuel amount calculating unit that calculates an actual necessary fuel amount as an amount of fuel actually needed in the previous suction stroke, based on the calculated actual intake air amount, at a fourth predetermined point in time that is later than the third predetermined point and is earlier than the time of closing of the intake valve in the suction stroke in question;

an actual intake fuel amount calculating unit that calculates an actual intake fuel amount as an amount of fuel actually inducted into the cylinder during the previous suction stroke, at a fifth predetermined point in time that is earlier than the time of closing of the intake valve in the suction stroke in question, the actual intake fuel amount being calculated based on at least an amount of fuel actually injected for the previous suction stroke;

a fuel feedback correction amount calculating unit that calculates a fuel feedback correction amount based on the calculated actual necessary fuel amount and the calculated actual intake fuel amount, at a sixth predetermined point in time that is later than the fourth and fifth predetermined points and is earlier than the time of closing of the intake valve in the suction stroke in question;

a normal estimated necessary fuel amount calculating unit that calculates a normal estimated necessary fuel amount as a normal fuel amount needed for the suction stroke in question, by correcting the calculated pre-correction estimated necessary fuel amount with the fuel feedback correction amount, at a seventh predetermined point in time that is later than the second and sixth predetermined points and is earlier than the time of closing of the intake valve in the suction stroke in question;

a fuel injection amount calculating unit that calculates a fuel injection amount as an amount of fuel to be injected from the fuel injector for the suction stroke in question, based on at least the calculated normal estimated necessary fuel amount, at an eighth predetermined point in time that is later than the seventh predetermined point and is earlier than the time of closing of the intake valve in the suction stroke in question; and a fuel injection commanding unit that generates a command to inject the fuel having the calculated fuel injection amount, to the fuel injector, at a ninth predetermined point in time that is later than the eighth predetermined point and is earlier than the time of closing of the intake valve in the suction stroke in question.

3. The apparatus according to claim 2, wherein:

the fuel feedback correction amount calculating unit calculates the fuel feedback correction amount based on at least a time integral value of a difference between the calculated actual necessary fuel amount and the calculated actual intake fuel amount; and the estimated intake air amount calculating unit and the actual intake air amount calculating unit are constructed such that, when the internal combustion engine is in a steady operating state, the estimated intake air amount calculated by the estimated intake air amount calculating unit and the actual intake air amount calculated by the actual intake air amount calculating unit become substantially equal to each other.

4. The apparatus according to claim 2, further comprising:

an actual fuel deposition amount calculating unit that calculates an actual fuel deposition amount as an amount of fuel deposited after a particular suction stroke and before a suction stroke that comes next to the particular suction stroke, based on a fuel injection amount that is actually injected for the particular suction stroke, an actual fuel deposition amount as an amount of fuel deposited after a suction stroke that precedes the particular suction stroke and before the particular suction stroke, and a fuel behavior model that represents the behavior of fuel deposited in an intake system of the engine, wherein:

the actual intake fuel amount calculating unit calculates the actual intake fuel amount as an amount of fuel actually inducted into the cylinder during the previous suction stroke, based on a forward model of the fuel behavior model, the actual intake fuel amount being calculated from an amount of fuel actually inducted into the cylinder during the previous suction stroke, out of an amount of fuel actually injected for the previous suction stroke, and an amount of fuel actually inducted into the cylinder during the previous suction stroke, out of the actual fuel deposition amount calculated by the actual fuel deposition amount calculating unit as an amount of fuel actually deposited after a second previous suction stroke that precedes the previous suction stroke and before the previous suction stroke; and the fuel injection amount calculating unit calculates the fuel injection amount based on a reverse model of the fuel behavior model so that a sum of an amount of fuel to be inducted into the cylinder during the suction stroke in question, out of the fuel injection amount to be injected for the suction stroke, and an amount of fuel to be inducted into the cylinder during the suction stroke in question, out of the fuel deposition amount calculated by the actual fuel deposition amount calculating unit as an amount of fuel actually deposited after the previous suction stroke and before the suction stroke in question becomes equal to the calculated normal estimated necessary fuel amount.

5. The apparatus according to claim 4, wherein:

the fuel feedback correction amount calculating unit calculates the fuel feedback correction amount based on at least a time integral value of a difference between the calculated actual necessary fuel amount and the calculated actual intake fuel amount; and the estimated intake air amount calculating unit and the actual intake air amount calculating unit are constructed such that, when the internal combustion engine is in a steady operating state, the estimated intake air amount calculated by the estimated intake air amount calculating unit and the actual intake air amount calculated by the actual intake air amount calculating unit become substantially equal to each other.

6. The apparatus according to claim 4, wherein:

the actual intake fuel amount calculating unit determines a fuel deposition rate and a fuel remaining rate used by the forward model of the fuel behavior model, based on the actual intake air amount for the time of closing of the intake valve in the previous suction stroke, and calculates the actual intake fuel amount based on the forward model of the fuel behavior model using the determined fuel deposition rate and fuel remaining rate; and the fuel injection amount calculating unit determines a fuel deposition rate and a fuel remaining rate used by the reverse model of the fuel behavior model, based on the estimated intake air amount, and calculates the fuel injection amount based on the reverse model of the fuel behavior model using the determined fuel deposition rate and fuel remaining rate.

7. The apparatus according to claim 6, wherein:

the fuel feedback correction amount calculating unit calculates the fuel feedback correction amount based on at least a time integral value of a difference between the calculated actual necessary fuel amount and the calculated actual intake fuel amount; and the estimated intake air amount calculating unit and the actual intake air amount calculating unit are constructed such that, when the internal combustion engine is in a steady operating state, the estimated intake air amount calculated by the estimated intake air amount calculating unit and the actual intake air amount calculated by the actual intake air amount calculating unit become substantially equal to each other.

* * * * *